US011590382B2

(12) United States Patent
Tedesco et al.

(10) Patent No.: US 11,590,382 B2
(45) Date of Patent: Feb. 28, 2023

(54) WEARABLE RESISTANCE TRAINING DEVICE

(71) Applicant: 1109 Bravo L.L.C., Louisville, KY (US)

(72) Inventors: Christopher L. Tedesco, Louisville, KY (US); Benjamin Bowlby, Zionsville, IN (US)

(73) Assignee: 1109 BRAVO L.L.C., Louisville, KY (US)

( * ) Notice: Subject to any disclaimer, the term of this patent is extended or adjusted under 35 U.S.C. 154(b) by 387 days.

(21) Appl. No.: 16/748,025

(22) Filed: Jan. 21, 2020

(65) Prior Publication Data

US 2020/0155891 A1 May 21, 2020

Related U.S. Application Data

(63) Continuation of application No. PCT/US2018/043138, filed on Jul. 20, 2018, which is (Continued)

(51) Int. Cl.
*A63B 21/00* (2006.01)
*A63B 23/035* (2006.01)
*A63B 69/00* (2006.01)

(52) U.S. Cl.
CPC .... *A63B 21/4025* (2015.10); *A63B 21/00069* (2013.01); *A63B 21/153* (2013.01); (Continued)

(58) Field of Classification Search
CPC ..... A63B 21/4025; A63B 21/00069; A63B 21/153; A63B 21/4007; A63B 21/4011; (Continued)

(56) References Cited

U.S. PATENT DOCUMENTS 3,162,442 A * 12/1964 Karlik ..... A63B 21/4005 24/129 R
4,944,511 A * 7/1990 Francis ..... A63B 21/153 482/123

(Continued)

OTHER PUBLICATIONS

International Search Report and Written Opinion issued in Application No. PCT/US2018/043138 dated Nov. 7, 2018.

*Primary Examiner* — Andrew S Lo
*Assistant Examiner* — Andrew M Kobylarz
(74) *Attorney, Agent, or Firm* — Gray Ice Higdon

(57) ABSTRACT

The described embodiments relate to systems, methods, and apparatuses for providing an adjustable amount of tension to various portions of a body of a user. The tension can be exhibited by cables that extend from the body mounted device. The cables can be routed through a pulley assembly located with cables guides of the body mounted device. A user can adjust the tension of the cables using knobs located at the ends of the cable guides. The cables can terminate at bands, which can be attached to appendages of the user during training. When the user is wearing the body mounted device, a mounting plate of the body mounted device can conform to the shoulders of the user, and a separate plate of the body mounted device can be depressed against a back side of the user.

17 Claims, 14 Drawing Sheets

Related U.S. Application Data a continuation-in-part of application No. 15/656,836, filed on Jul. 21, 2017, now Pat. No. 10,576,325.

(60) Provisional application No. 62/641,902, filed on Mar. 12, 2018.

(52) U.S. Cl.
CPC ..... *A63B 21/4007* (2015.10); *A63B 21/4011* (2015.10); *A63B 21/4021* (2015.10); *A63B 21/4043* (2015.10); *A63B 23/03541* (2013.01); *A63B 69/0028* (2013.01); *A63B 2220/833* (2013.01); *A63B 2225/09* (2013.01)

(58) Field of Classification Search
CPC ..... A63B 21/4021; A63B 21/4043; A63B 23/03541; A63B 69/0028; A63B 2220/833; A63B 2225/09; A63B 21/00185; A63B 21/04; A63B 21/0442; A63B 21/055; A63B 21/154; A63B 21/4009; A63B 69/00; A63B 2220/12; A63B 2220/80; A63B 2220/807; A63B 24/0087; A63B 2024/0068; A63B 2220/10; A63B 2220/54; A63B 2220/836
See application file for complete search history.

(56) References Cited

U.S. PATENT DOCUMENTS 4,961,573 A 10/1990 Wehrell
5,234,395 A 8/1993 Miller et al.
5,328,432 A 7/1994 Gvoich
5,358,461 A * 10/1994 Bailey, Jr. ..... A63B 21/153 290/1 R
5,618,249 A * 4/1997 Marshall ..... A63B 21/4001 482/92
5,792,034 A * 8/1998 Kozlovsky ..... A63B 21/4025 482/124
6,099,447 A 8/2000 Ramsaroop
6,280,365 B1 * 8/2001 Weber ..... A63B 21/4001 482/124
6,659,921 B2 12/2003 Vernon
7,147,590 B2 12/2006 Toven
7,297,090 B2 11/2007 Torres
7,563,212 B2 * 7/2009 Smith ..... A63B 21/4025 482/124
7,850,583 B2 12/2010 Smith
7,854,694 B1 12/2010 Frunzi
8,323,127 B2 12/2012 Webb
8,926,480 B2 1/2015 Lyszczarz
8,979,709 B2 3/2015 Toback et al.
9,345,942 B2 5/2016 Stevens
9,409,501 B2 8/2016 Henry
D797,868 S * 9/2017 Thomas ..... D21/683
9,795,818 B2 10/2017 Powell
10,207,140 B2 * 2/2019 Carriere, Jr. ..... A63B 21/151
10,888,728 B2 * 1/2021 Carriere ..... A63B 21/0087
2004/0053755 A1 * 3/2004 Wilkinson ..... A63B 23/03541 482/126
2005/0221965 A1 10/2005 Boland
2005/0282689 A1 12/2005 Weinstein
2006/0229173 A1 10/2006 Foley
2007/0219074 A1 9/2007 Pride
2009/0062087 A1 3/2009 Poppinga
2010/0292051 A1 * 11/2010 Benumof ..... A63B 21/4003 482/10
2011/0111890 A1 * 5/2011 Webb ..... A63B 21/4025 482/124
2011/0183819 A1 * 7/2011 Pharoe ..... A63B 21/4025 482/105
2012/0322635 A1 12/2012 Carter
2013/0324366 A1 * 12/2013 Pride ..... A63B 21/153 482/1
2014/0357457 A1 * 12/2014 Boekema ..... A63B 21/4025 482/124
2015/0011368 A1 1/2015 Manor et al.
2015/0328520 A1 11/2015 Barnes
2016/0008655 A1 1/2016 Martin
2016/0074699 A1 3/2016 Walter et al.
2016/0206912 A1 * 7/2016 Carriere, Jr. ..... A63B 21/4043
2017/0100626 A1 * 4/2017 Ko ..... A63B 21/153
2018/0021624 A1 1/2018 Cordero
2019/0022452 A1 * 1/2019 Tedesco ..... A41D 1/04
2019/0175975 A1 * 6/2019 Carriere ..... A61H 1/0229
2020/0155891 A1 * 5/2020 Tedesco ..... A63B 21/055

* cited by examiner

WEARABLE RESISTANCE TRAINING DEVICE

TECHNICAL FIELD

The embodiments described herein generally to wearable resistance devices. Specifically, the embodiments relates to systems, methods, and apparatuses for providing tension to different appendages of a person using a wearable resistance device.

BACKGROUND

Exercise devices typically encourage users to work out in a static environment to reduce the risk of injury. However, some professions may require that a person train in a variety of environments in order to prepare for unpredictable situations. Such professions can include the military, where trainees may be forced to exert themselves in a variety of environments. Therefore, by training with a device that is not meant to travel, or otherwise be used in different environments, such trainees may not be adequately prepared to maneuver under unpredictable conditions. Other professions where the combination of mobility and resistance can be beneficial include professional athletics, law enforcement, and function specific rehabilitation. Essentially, any profession or vocation where enhanced physical ability can equate to higher performance or lower incidence of injury. Furthermore, by only training under a limited number of conditions, risk of injury can increase because the trainee may not have the muscle memory or brain plasticity to adapt to unpredictable situations.

SUMMARY

The described embodiments relate to systems, methods, and apparatuses for providing tension to multiple areas of a person to improve training, exercise, therapy or rehabilitation. In some implementations, a wearable apparatus is set forth as including a housing portion comprising one or more cable guides configured to direct cables from the housing portion in different directions. The housing portion can further include a pulley assembly that includes a plurality of pulleys and a pulley mount. The pulley assembly can be configured to modify an amount of tension exhibited by the cables. The wearable apparatus can further include a mounting plate that extends from a first portion of the housing portion, and a back plate that extends from a second portion of the housing portion. The second portion of the housing portion can include apertures through which pins connect the back plate to the second portion of the housing portion. The pins can be compressible and displace the back plate a distance from the second portion of the housing portion. The pulley assembly can include a first pulley that is proximate to an aperture of a cable guide of the one or cable guides, and a second pulley connected between the first pulley and the pulley mount. The pulley assembly can further include a third pulley connected to the pulley mount and a threaded portion that extends through the pulley mount. The pulley mount can be configured to move along a length of the cable guide when the threaded portion receives a rotational force. The housing portion can include non-parallel interior walls, and each cable guide of the one or more cable guides extend along a respective interior wall of the non-parallel interior walls. The pulley assembly can be at least partially disposed within a cable guide of the one or more cable guides. At least one cable of the cables can extend into a cable guide of the one or more cables guides, curve around at least three pulleys of the plurality of pulleys, and extend out of the cable guide of the one or more cable guides.

In other implementations, a wearable apparatus is set forth as including a housing portion that includes a first cable guide and a second cable guide configured to direct cables in different directions from the housing portion. The wearable apparatus can further include a first pulley assembly connected to the first cable guide and a second pulley assembly connected to the second cable guide. Each of the first pulley assembly and the second pulley assembly can include a plurality of pulleys, a pulley mount, and a threaded portion that extends through the pulley mount. The first cable guide and the second cable guide are non-parallel and at least partially envelop the first pulley assembly and the second pulley assembly, respectively. The wearable apparatus can further include a curved mounting plate and pivotable straps extending from the curved mounting plate. The wearable apparatus can further include a chest strap that is connected to each of the pivotable straps and extends between the pivotable straps. The wearable apparatus can include a control system that includes a sensor and an actuator that is configured to modify an arrangement of the first pulley assembly or the second pulley assembly according to an output from the sensor. The threaded portion can extend between two pulleys of the plurality of pulleys, and the two pulleys can be attached to the pulley mount.

In some implementations, a method for operating a body mountable device is set forth as including operations such as receiving an amount of force at a pulley assembly that is connected to the body mountable device. The pulley assembly can be configured to adjust an amount of tension exhibited by a cable that extends from the body mountable device. The method can also include modifying an arrangement of the pulley assembly in response to receiving the amount of force. Modifying the arrangement can include displacing a location of a pulley mount of the pulley assembly. The method can also include causing the amount of tension exhibited by the cable to be adjusted in response to modifying the arrangement of the pulley assembly. The amount of tension can be at least partially dependent on the location of the pulley mount relative to a pulley that is disposed within a cable guide of the body mountable device. The cable can be disposed about the pulley and a separate pulley, and the separate pulley is attached to the pulley mount. The pulley assembly can be controlled by a control system that includes a motor and a sensor, and the amount of force received at the pulley assembly can be provided by the motor. The sensor can be responsive to an environmental condition of the body mountable device or a separate device, and the amount of tension exhibited by the cable can be at least partially based on an output of the sensor. The pulley mount can include cable apertures through which the cable extends.

In other implementations, a method for operating a body mounted device is set forth as including operations such as receiving sensor data from one or more sensors associated with a body mounted device. The body mounted device can include a pulley assembly and a cable configured to provide tension to a body of a person wearing the body mounted device. The method can also include determining an amount of desired tension for the cable based on the received sensor data, and causing the pulley assembly to re-arrange according the determined amount of desire tension. The body mounted device can include a pulley sensor configured to provide an output according to a current amount of tension exhibited by the pulley sensor, and the method can further include determining the current amount of tension exhibited by the pulley sensor. The one or more sensors can include a body sensor that can be connected to the body of the person wearing the body mounted device, and the sensor data can be received in response to a motion of the person wearing the body mounted device. The body mounted device can include an actuator, and causing the pulley assembly to re-arrange can include causing the actuator to rotate a threaded portion of the pulley assembly.

In yet other implementations, a method for operating a body mounted device is set forth as including operations such as receiving sensor data from one or more sensors associated with a body mounted device. The body mounted device can include a pulley assembly and a cable configured to provide tension to a body of a person wearing the body mounted device. The method can also include determining, based on the received sensor data, that a current tension provided by the cable needs to be adjusted, and controlling at least one actuator to cause adjustment of the current tension provided by the cable. Determining, based on the received sensor data, that the current tension provided by the cable needs to be adjusted can include: determining a desired tension based on the received sensor data; and determining the desired tension differs from the current tension by at least a threshold amount. Controlling the at least one actuator to cause adjustment of the current tension provided by the cable can include: controlling the actuator based on the desired tension. Controlling the at least one actuator can cause a position of the cable assembly to be adjusted and to thereby adjust the current tension.

In some implementations, a method performed by one or more processors is set forth as including steps such as receiving, from one or more sensors, data related to a motion of a user that is wearing a resistance assembly. The one or more sensors can include a pedometer, camera, position sensor, torque sensor, GPS device, and/or any other sensor that can be attached to a user. The data can correspond to the motion of appendages of the user. The steps can further include, determining, based on the data, a metric that is associated with a performance of the user, and causing a tension or a resistance of one or more cables of the resistance assembly to increase or decrease based on the metric. For instance, in response to the metric reaching a predetermined threshold, a computing device can control an actuator or other electromechanical device to increase or decrease tension at the one or more cables.

In other implementations, a wearable apparatus is set forth as including a first plate that includes joints that extend from a surface of the first plate, and a mount that includes cable pathways and at least two pipes extending from the mount. The wearable apparatus can further include cable spools that each rotate around each joint and provide cable that extends through the cable pathways and the at least two pipes, and a second plate that is connected to the joints and extends over the first plate and the cable spools. The at least two pipes can direct the cables in different directions to provide separate amounts of tension to appendages of a user to whom the cables are connectable. The mount can extend from a first end of the first plate, and the wearable apparatus can further include a clip that extends from a second end of the first plate over a bottom surface of the first plate. Each joint can include a rod that extends from the surface of the first plate, and the clip can extend from the first plate away from each joint. The cable spools can be configured to provide an adjustable amount of tension to the cables. The cables spools can include a first cable spool and a second cable spool, the first cable spool being connected to a first joint located at a first corner of the first plate, and the second cable spool being connected to a second joint located at a second corner of the first plate. Each joint can penetrate an aperture of a cable spool and define an axis of rotation for the cable spool. The wearable apparatus can include a sensor configured to provide signals according a performance of a user to which the cable is connected. Additionally, the wearable apparatus can include a computing device connected to the sensor and configured to dynamically cause changes in tension to the cable based on the performance of the user as indicated by the signals.

In yet other implementations, a method for providing a wearable apparatus is set forth. The method can include attaching a cable spool to a joint of a first plate, the first plate including a pipe mount with a cable pathway. The steps can further include connecting a pipe to the pipe mount such that the pipe extends away from the first plate and the joint, and directing cable from the cable spool through the cable pathway of the pipe mount and the pipe. The steps can also include connecting a second plate to the joint of the first plate to retain the cable spool between the first plate and the second plate. The joint can extend through an aperture of the cable spool and provide an axis of rotation for the cable spool. The steps can further include connecting multiple pipes to the pipe mount, the multiple pipes extending from the pipe mount in different directions. The pipe mount can include multiple cable pathways, and each cable pathway can include an opening located at a surface of the pipe mount. The cable spool can be configured to provide an amount of tension on the cable in a direction that pulls the cable back through the pipe. The second plate can extend over the cable spool and the cable.

In yet other implementations, a system is set forth as including a plate that includes a pipe mount from which a pipe extends, and a cable pathway through which a cable passes. The system can further include a cable spool that supplies the cable that passes from the cable spool through the pipe mount and the pipe, and a pulley for redirecting a cable from the pipe in a trajectory that is different than a direction in which the pipe extends. The system can also include a strap that supports the plate when the strap is worn by a user. The pulley and the cable can be configured to attach at separate locations on the user to create tension at the separate locations. The system can further include a separate plate that at least partially extends over the cable spool and the cable. The cable spool can be configured to provide an adjustable amount of tension to the separate locations on the user. An opening of the pipe can face away from the plate and towards the pulley. The plate can further include a clip that extends over a side of the plate that opposes the cable spool. The system can also include multiple cable spools configured to provide multiple cables through the pipe mount. Each of the multiple cables spools can include separately adjustable tension, and a vest configured to be worn by the user and support the multiple cable spools and the plate.

DETAILED DESCRIPTION OF THE INVENTION

The described embodiments relate to systems, methods, and apparatuses for using a body mounted device to apply physical resistance to a user during training or therapy. Strenuous occupations such as military service, professional athletics, and rehabilitation services can typically require physical training. Current training methods can include repetitive tactical drills and resistance training, which can include significant risk of injury. Furthermore, current resistance training devices are often stationary, being attached to a floor or wall, thereby offering no mobility for trainees that typically perform mobility exercises. Moreover, group exercises are not typically possible with stationary training devices, thereby limiting the ability to simulate real-world scenarios where multiple persons are involved.

The body mounted device discussed herein allows for special mobility and adjustable resistance during training, thereby allowing for a variety of tactical and group activities to be undertaken. The body mounted device can include a backpack, bodysuit, waistband, belt, elbow band, knee band, wristband, arm band, leg band, and/or any other wearable resistance device or combination of resistance devices. The body mounted device allows for a range of movements and patterns of motion, and is adjustable for multiple different body sizes.

The body mounted device can use tethers to attach to portions of the body to allow for unrestricted motion with intentional resistance while performing therapeutic and/or occupational related movements during training. For instance, resistance at the arm can improve motion stability and draw speed during simulations involving weapons training. In some instances, the body mounted device can include sensors, such as an accelerometer capable of detecting motion in three dimensions. The sensors can track various different metrics that can be presented to the user, so that the user will be able to tell how they are improving and make adjustments to the body mounted device to continue making progress.

Figure 1A:
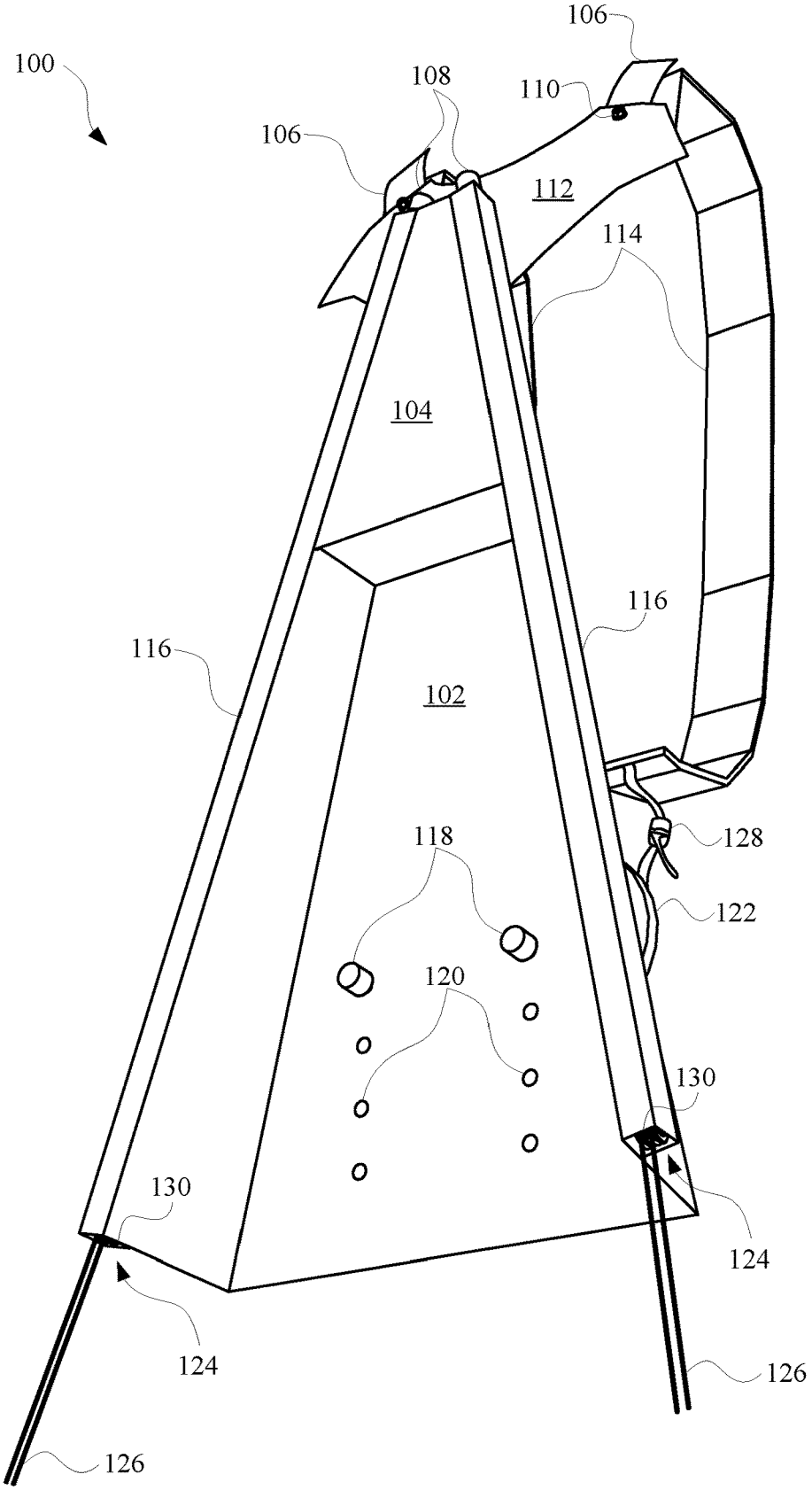
FIG. 1A illustrates a perspective view of a body mounted device that can include multiple different adjustable cables for providing resistance to various portions of a user during training being undertaken by the user.

FIG. 1A illustrates a perspective view 100 of a body mounted device (i.e., a wearable apparatus, a body mountable device, a body mounted device) that can include multiple different adjustable cables 126 for providing resistance to various portions of a user during training being undertaken by the user. The body mounted device can include multiple straps 114, which can be adjusted by way of a tension device 128 connected to each strap 114. In some implementations, the body mounted device can include a chest strap that is connected to each strap 114 and extends between the straps 114. In some implementations, a cable extending from the body mounted device can be connected to a head strap, which can be disposed about the skull of a user in order to provide an amount of resistant to the head of the user during training. The body mounted device can further include pulleys 124 (i.e., cable spools), which can be located within cable guides 116 that are connected to the body of the body mounted device. The body of the body mounted device can further include a first portion 104 and a second portion 102, which can be coplanar or non-coplanar surfaces with respect to the body of the body mount device. The cable guides 116 can extend along an edge of the first portion 104 and/or a second portion 102, and can at least partially envelop the cables 126 and the pulleys 124. The first portion 104 and/or the second portion 102 of the body mounted device can act as a pipe mount for each of the cable guides 116 (i.e., pipes), and each cable guide 116 (i.e., pipe) can extend toward the torso, feet, legs, or other portions of the user.

Each cable 126 can terminate at a wristband, which can be worn by the user in order to provide adjustable resistance during exercise or other training. The tension exhibited by the cables 126 can be adjustable by way of an adjustable device 108. The adjustable device 108 can, for example, be a knob that is connected to a threaded screw that extends through a respective cable guide 116. When the knob is turned in a first direction, a location of a pulley internal to a cable guide 116 can become more proximate to a pulley that is located at a distal end of the cable guide 116. When the knob is turned in a second direction, that is opposite the first direction, a location of the pulley internal to the cable guide 116 can become less proximate to the pulley that is located at the distal end of the cable guide 116. In this way, the user can simply reach over their shoulder and turn the knob during training in order to adjust the amount of tension exhibited by the cables 126 as the cables 126 move in and out of an aperture 130 of each cable guide 116.

In some implementations, the knobs can be actuators or motors that adjust a tension of the cables 126. The actuators can be controlled based on sensor data generated at the body mounted device or a separate device. For instance, the body mounted device can include a control system that includes one or more sensors that are responsive to an environment of the user and/or the body mounted device. When a particular feature of the environment changes, the actuators can be adjusted in response, thereby causing changes to the tension exhibited by the cables. For instance, the one or more sensors can include a timing sensor, location sensor, temperature sensor, moisture sensor, proximity sensor, and/or any other sensor capable of being responsive to environmental conditions.

In some implementations, the cable guides 116 can be non-parallel, and therefore separated by an angle that is less than 90 degrees. In some implementations, the angle between the cable guides 116 can be less than 45 degrees. In other implementations, the angle between the cable guides 116 can be between 45 degrees and 15 degrees. In yet other implementations, the angle between the cable guides 116 can be between 65 degrees and 25 degrees. For instance, the angle between the cables guides 116 can be 25 degrees, 30 degrees, or 35 degrees. However, in some implementations, the cable guides 116 can be any angle that is suitable for directing cables to appendages of a user of the body mounted device.

The second portion 102 can act as a plate that is able to receive pins 118 through apertures 120 of the second portion 102. The pins 118 can be separable from a plate 122, which can be arranged to abut a back portion of the user when the user is wearing the body mountable device. In this way, the plate 122 can be adjusted to abut different portions of the backside of the user in order to distribute any force from the body mounted device in a more comfortable manner. The tension device 128 attached to each strap 114 can also be adjustable in order to move a location of the plate 122 over the backside of the user. The straps 114 can be attached to the body mounted device using one or more pins 110. Each pin 110 can extend through a distal end of each strap 114 and a mounting plate 112, which can extend from the first portion 104 and/or the second portion 102 of the body mounted device. Each pin 110 can allow each strap 114 to be rotatable about an axis defined by each pin 110. In this way, each strap 114 can adjust to different shapes of shoulders of different users. In some implementations, the body mounted device can include support plates 106, which can extend from the mounting plate 112 over at least a portion of the straps 114. This can protect the straps 114 and the body mounted device to conform to the body of the user.

Figure 1B:
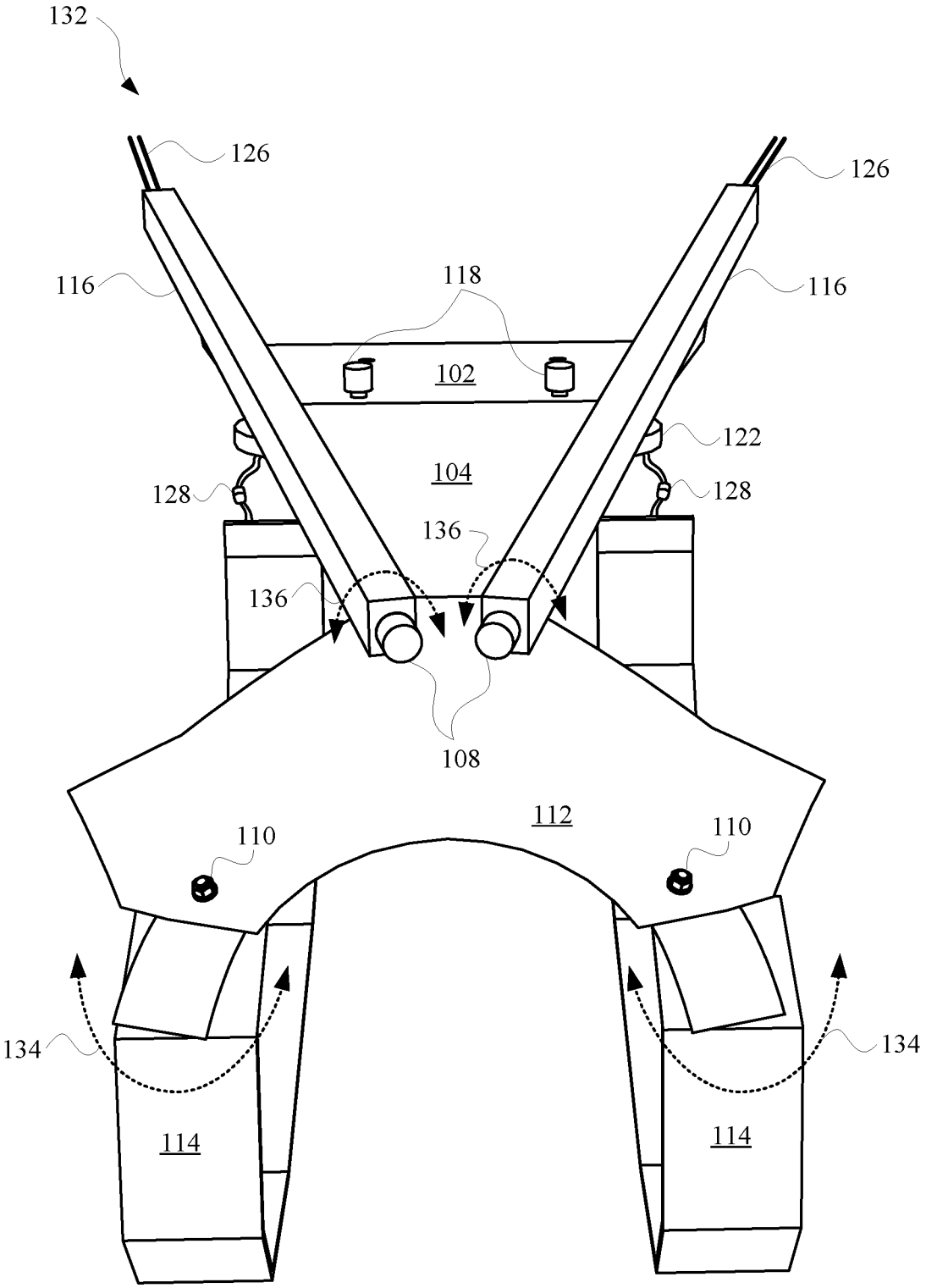
FIG. 1B illustrates a top view of the body mounted device.

FIG. 1B illustrates a top view 132 of the body mounted device. Specifically, FIG. 1B illustrates how each pin 110 can allow each strap 114 to exhibit a rotational direction 134 about each pin 110, respectively. By allowing each strap 114 to pivot about each pin 110 along the rotational direction 134, each strap 114 can conform to a shape of a body of the user. This can allow the body mounted device to be more securely fastened to the body of the user, thereby allowing the user to modify the tension exhibited by the device without sacrificing comfort. Tension of the cables 126 can be modified by adjusting the adjustable device 108. Each adjustable device 108 can be rotated in the same or different directions 136 in order to provide a balanced or unbalanced amount of tension at each of the cables 126. For instance, a user can rotate each of the adjustable devices 108 in the same direction in order to provide a substantially equal amount of tension on the body of the user wearing the body mounted device. Alternatively, the user can rotate the adjustable devices 108 in different directions in order to provide a different amount of tension at different portions of the body.

In some implementations, the body mounted device can be configured to be at least partially displaced from the back side of a user when the body mounted device is worn by the user. For example, the plate 122 can abut a back side of the user when the user is wearing the body mounted device, and the second portion 102 of the body mounted device can be displaced from the back side of the user as a result. Furthermore, when the user is wearing the body mounted device, the mounting plate 112 can abut the shoulders or other back side of the user, and the first portion 104 of the body mounted device can be displaced from the shoulders or other back side of the user as a result. By displacing the body mounted device from the user in this way, the user can experience less friction from wearing the body mounted device, thereby allowing the user to train for longer periods of time without experiencing fatigue from friction.

In some implementations, the cables 126 can terminate at bands that can be worn at wrists, knees, joints, and/or any other portion of the body of a user. Specifically, a pair of cables 126 can extend from an aperture 130 of the body mounted device, and the pair of cables 126 can terminate at the bands for connecting to a portion of the body of the user. Each band can include Velcro portions for securing to a respective portion of the body. In some implementations, the cables 126 can be connected to pulleys located at the bands, for allowing the motions of the cables 126 to be more fluid, despite the amount of tension exhibited by the cables 126. In some implementations, intermediate pulleys can be attached to the body of the user, and the cables 126 can pass through the intermediate pulleys before terminating at the bands. For instance, the body mounted device can be a system that includes intermediate pulleys, that can be attached to the waste, knees, elbows, and/or any other portion of the body, and bands at which the cable 126 passing through the intermediate pulleys, from the apertures 130, can pass. Therefore, as the user maneuvers while wearing the cables 126, the cables 126 will provide resistance at locations where the bands are attached and/or where the intermediate pulleys are attached. In some implementations, the bands can include pulleys and/or pivoting ends that allow the bands to rotate independently from a motion of the cables 126.

In some implementations, the body mounted device can include cables that extend from apertures 130, and separate other apertures where the adjustable devices 108 are located. For instance, in some implementations, the body mounted device can include cable guides 116 with cables extending away from the mounting plate 112, and other cable guides with other cables that extend away from the plate 122. Alternatively, the cable guides 116 can include cables 126 that extend away from the mounting plate 112, and other cables that extend away from the plate 122. In this way, the user can operatively couple the cables 126 to a lower portion of their body and the other cables to an upper portion of their body. Furthermore, an amount of tension at each cable can be individually adjusted in order to provide varying amounts of tension across the body of the user during training with the body mounted device.

Figure 1C:
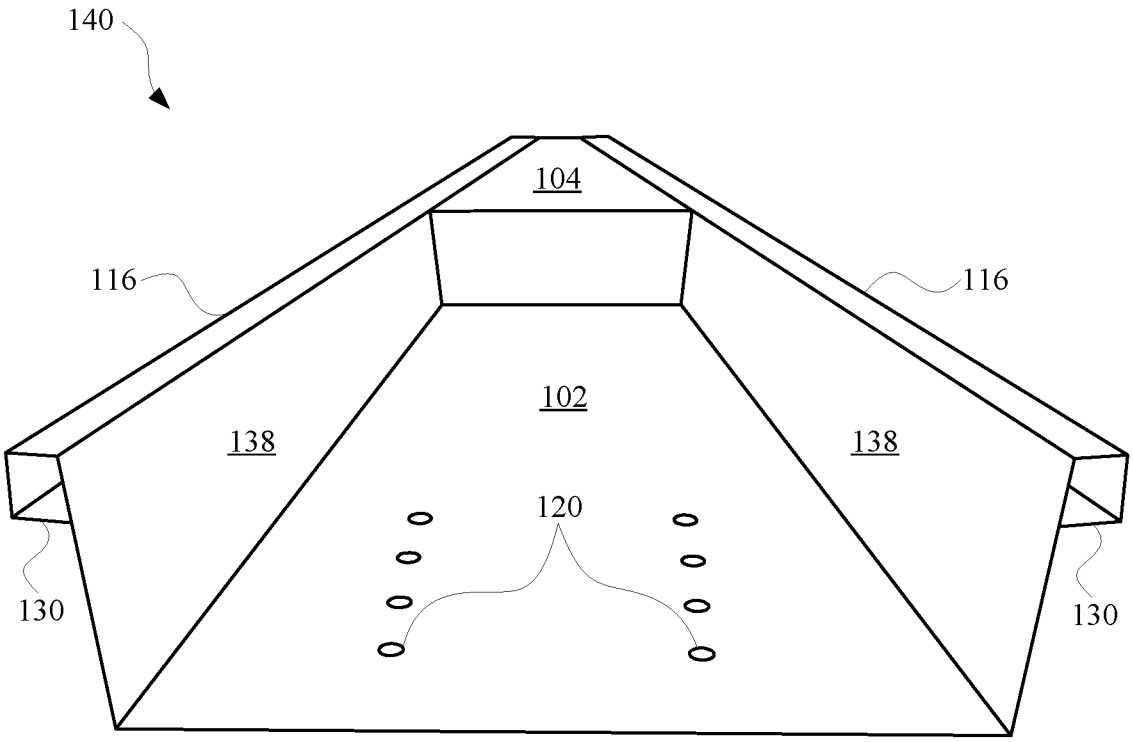
FIG. 1C illustrates a housing portion that is isolated from the body mounted device for purposes of illustrating the housing portion.

FIG. 1C illustrates a housing portion 140 that is isolated from the body mounted device for purposes of illustrating the housing portion 140. The housing portion 140 can include a first portion 104 and a second portion 102, which can include non-coplanar surfaces relative to each other. The second portion can include interior walls 138, which can be parallel or non-parallel in their arrangement. For instance, in some embodiments, the interior walls 138 can be non-parallel walls that have varying widths along the length of the housing portion 140. This can allow any cables extending from the housing portion 140 to be further displaced from the body of the user, at least where the cables initially exit the apertures 130 of the housing portion 140. The apertures 130 can provide hollow channels through the entire length of the housing portion 140. The housing portion 140 can optionally include apertures 120, which can allow a plate to be attached to the housing portion 140 by way of pins that can extend through the apertures 120, for securing the plate to the housing portion 140.

Figure 1D:
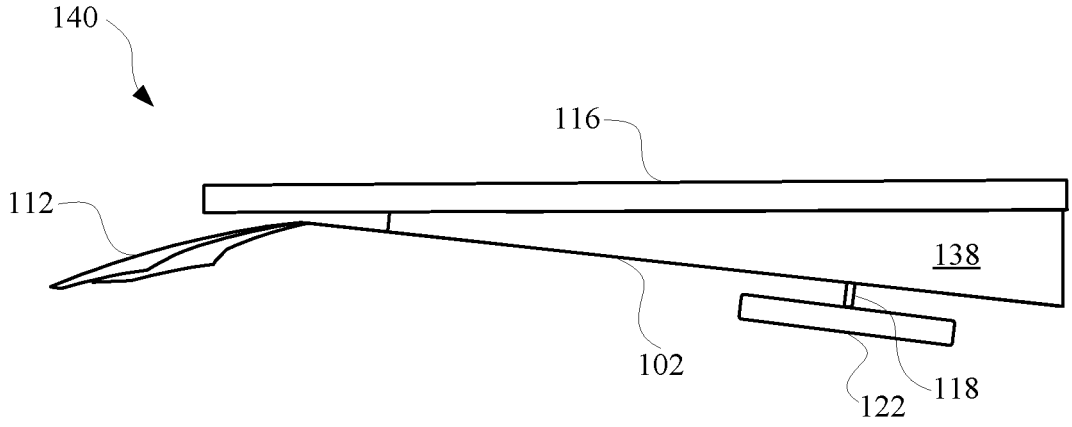
FIG. 1D illustrates a side view of the housing portion with a plate attached.

FIG. 1D illustrates a side view of the housing portion 140 with the plate 122 attached. The side view shows how the housing portion 140 can be a single uniform piece of material. Specifically, the housing portion 140 can be made from a material such as, but not limited to, carbon fiber, plastic, metal, alloy, and/or any other material that can be incorporated into a training device. In some implementations, the housing portion 140 can be comprised of multiple layers of the same or different materials. The second portion 102 of the housing portion 140 can be connected to the mounting plate 112 directly or indirectly. For instance, the mounting plate 112 can be integral to the second portion 102, thereby allowing the housing portion 140 to have a seamless surface, further providing additional comfort when wearing the body mounted device.

In some implementations, pins 118 connecting the plate 122 to the second portion 102 of the body mounted device can be made from a flexible material. For example, the pins can be made from a rubber, plastic, and/or foam material that can be compressed without permanently deforming the pins 118. This can provide an additional layer of comfort for a user that is wearing the body mounted device. In some implementations, the plate 122 can include multiple layers, such as a soft compressible layer that faces away from the second portion 102. In some implementations, the plate 122 can include a Velcro layer, or other adhesive layer, that allows an outer most layer of the plate 122 to be attached and removed.

Figure 1E:
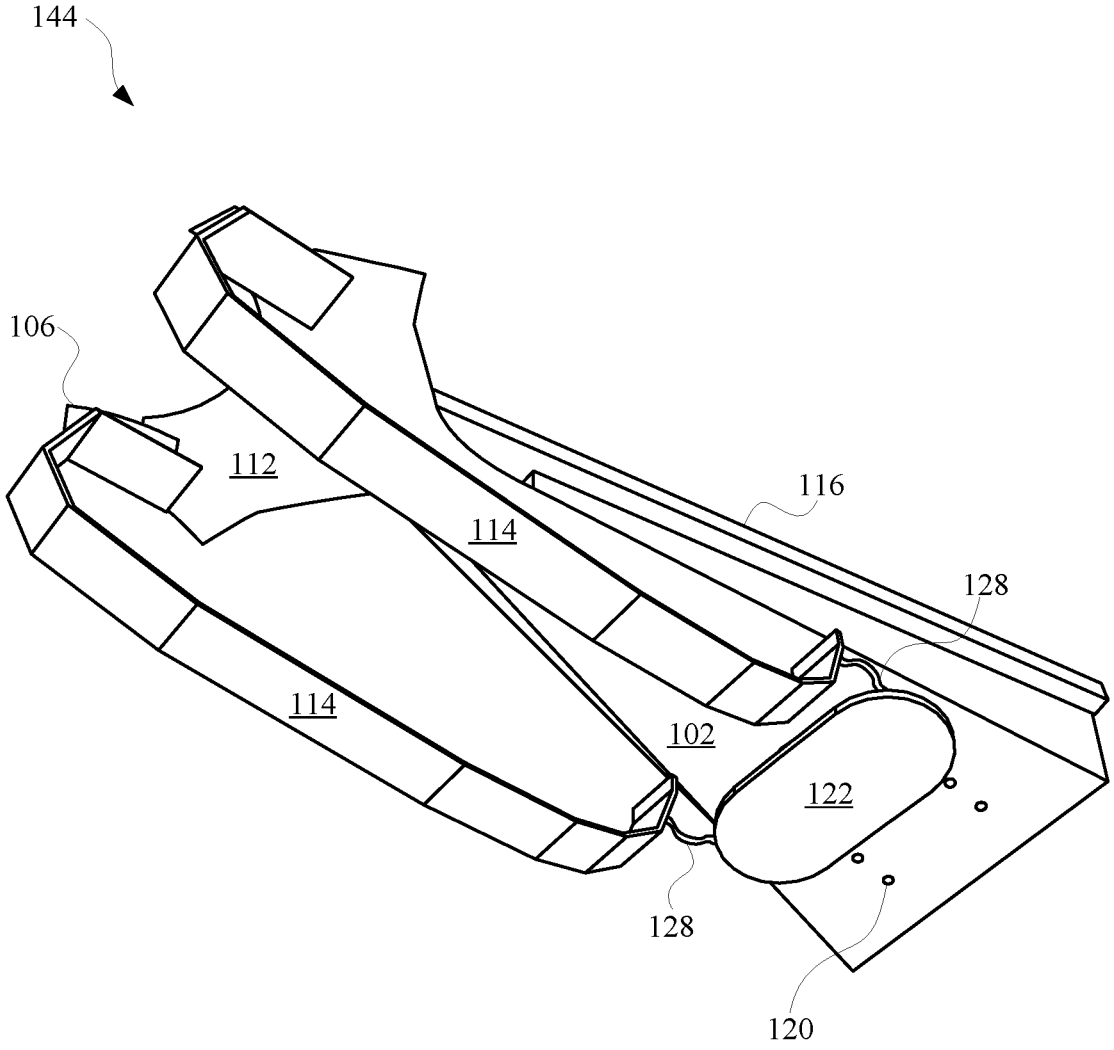
FIG. 1E illustrates a back view of the body mounted device.

FIG. 1E illustrates a back view 144 of the body mounted device. The back view 144 shows how the plate 122 can be connected to the body mounted device. The plate 122 can be connected to the body mounted device using pins 118, which can extend from the second portion 102 of the body mounted device to the plate 122. The plate 122 can be offset from a surface of the second portion 102 by a distance that is suitable for prevent other surfaces, such as the cable guides 116, from contacting the user. In some implementations, the amount of offset of the plate 122 from the second portion 102 of the body mounted device can be adjustable. The location of the pins 118, and thus the plate 122, can be adjusted according to which apertures 120 the pins 118 are extending through.

Figure 2A:
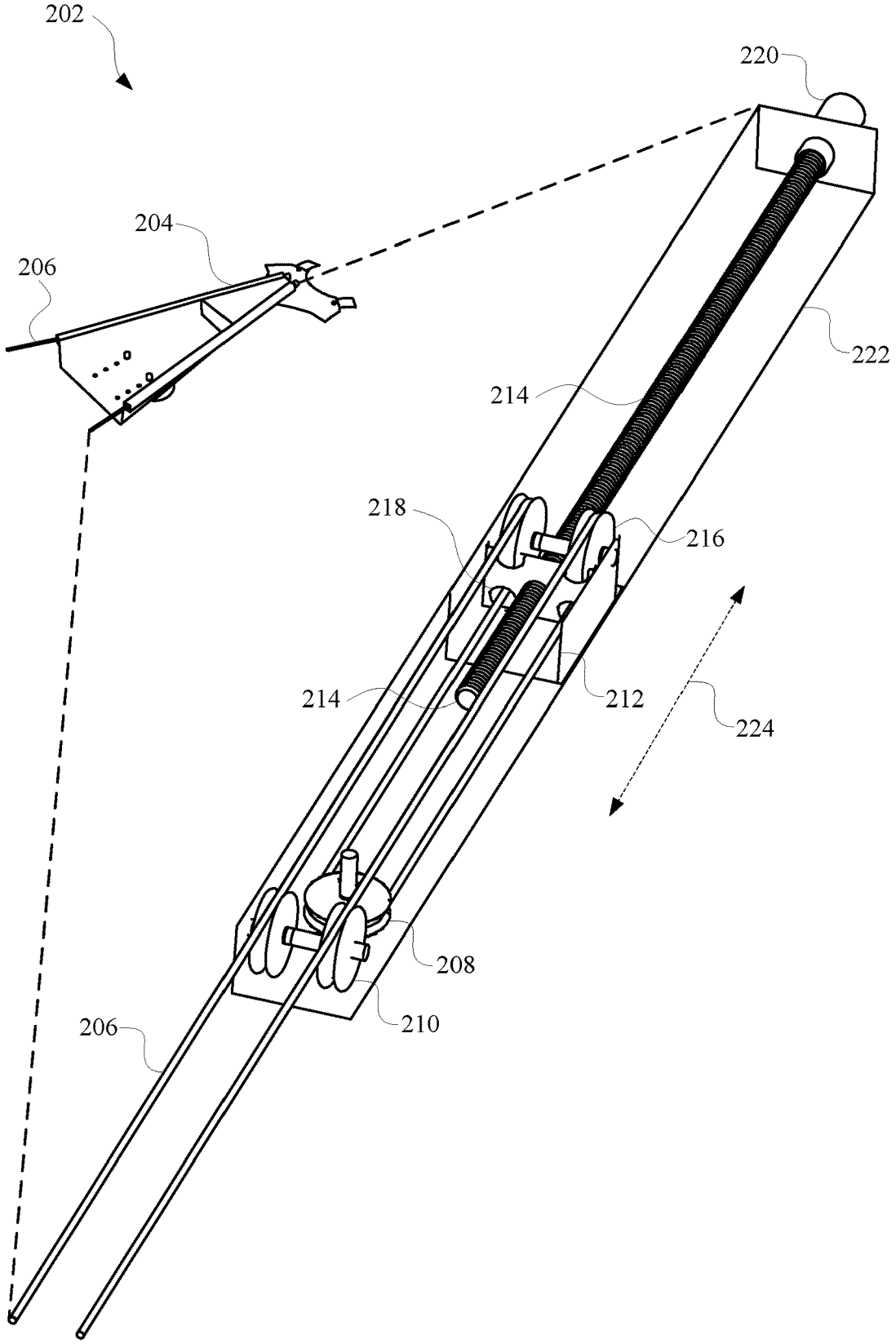
FIG. 2A illustrates a hidden view of a cable spool assembly that can be incorporated into a cable guide of a body mounted device.

FIG. 2A illustrates a hidden view 202 of a cable spool assembly that can be incorporated into a cable guide 222 of a body mounted device 204. The cable spool assembly can operate to allow adjustable amounts of tension to be exhibited by cables 206. A cable 206 can be a single cable that extends into a cable guide 222, through various portions of the cable spool assembly, and extends back out of the cable guide 222. For purposes of illustration, surfaces of the cable guide 222 are removed in order to illustrate how the cable spool assembly can be disposed within the cable guide 222.

The cable spool assembly can include an adjustable device 220, which can be a knob or any other grippable apparatus that can be rotated in order to adjust an amount of tension exhibited by the cable 206. The adjustable device 220 can be connected to a threaded portion 214, which can extend parallel to a link of the cable guide 222. The threaded portion 214 can terminate between different pulleys or spools of the cable spool assembly. For instance, a first pulley 210 can be located adjacent to an aperture 228 of the cable guide 222. In some implementations, the first pulling 210 can be a pair of pulleys that are connected to the cable guide 222, such that a rotational axis of the first pulley 210 extends perpendicular to a length of the cable guide 222 and/or a length of the threaded portion 214.

The cable spool assembly can further include a second pulley 208 that has a rotational axis that is perpendicular to a rotational axis of the first pulley 210. The second pulley 208 can act to hold the cable 206 in place as the tension of the cable 206 is adjusted by way of the adjustable device 220. The tension of the cable 206 can be adjusted by turning the adjustable device 220 to cause the threaded portion 214 to move a pulley mount 212, that includes a third pulley 216. The third pulley 216 can include on or more pulleys and be attached to the pulley mount 212, thereby allowing the third pulley 216 to traverse a length 224 of the cable guide 222 as the pulley mount 212 moves along the cable guide 222. The pulley mount 212 can include a threaded aperture through which the threaded portion 214 can extend. As the adjustable device 220 is rotated, the threaded portion 214 can cause the pulley mount 212 to maneuver toward or away from the second pulley 208. This can cause changes to an amount of tension exhibited by the cable 206 and/or a length of the cable 206. The pulley mount 212 can also include cable holes for allowing the cable 206 to pass through the pulley mount 212, around the third pulley 216, and back through other cable holes of the pulley mount 212.

Figure 2B:
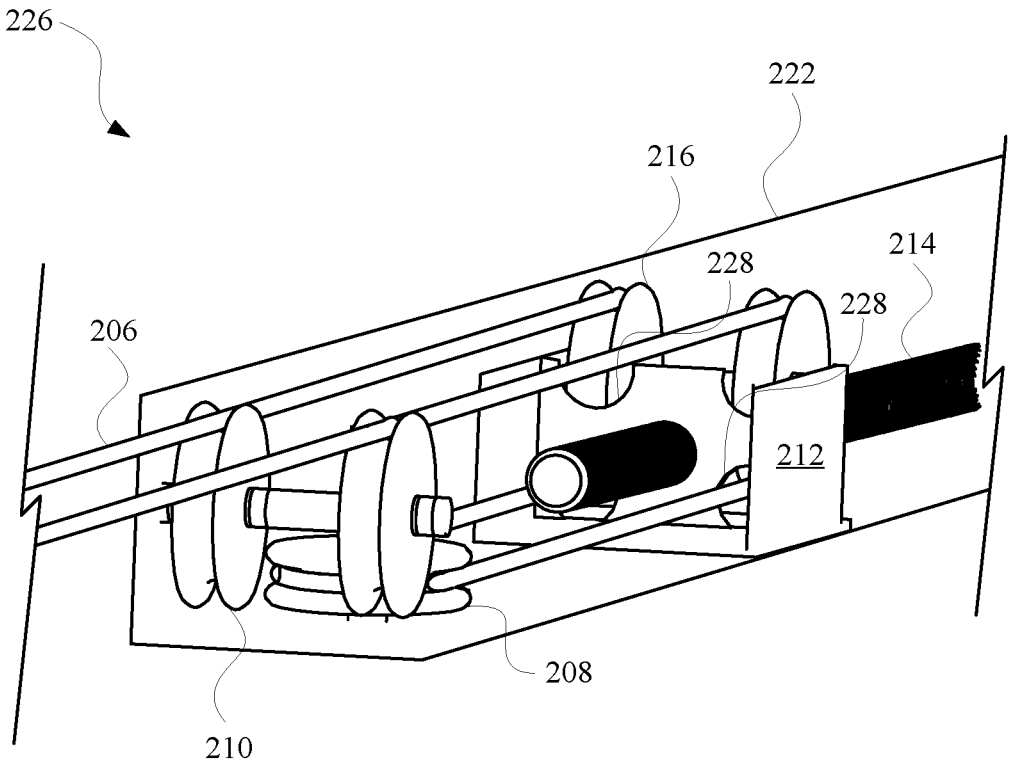
FIG. 2B illustrates a perspective view of the cable spool assembly, which includes further details of the pulley mount.

FIG. 2B illustrates a perspective view 226 of the cable spool assembly, which includes further details of the pulley mount 212. Furthermore, the perspective view 226 illustrates how the first pulleys 210 can be attached to the cable guide 222 at a distal end of the cable guide 222. The second pulley 208 can be attached to the cable guide 222 at a different surface of the cable guide 222 than the first pulleys 210 are attached to. Furthermore, the second pulley 208 can be attached to the cable guide 222 between the first pulley 210 and the pulley mount 212. The pulley mount 212 can include apertures 228 and/or cable holes/guides that allow the cables to pass in and out of the pulley mount 212. For instance, when the threaded portion 214 of the cable spool assembly is rotated, the cable 206 can be pulled in or out of the cable guide 222, depending on the rotation in which the threaded portion 214 is being rotated. As a result, different portions of the cable 206 will move pass through the pulley mount 212 in different directions.

Figure 3:
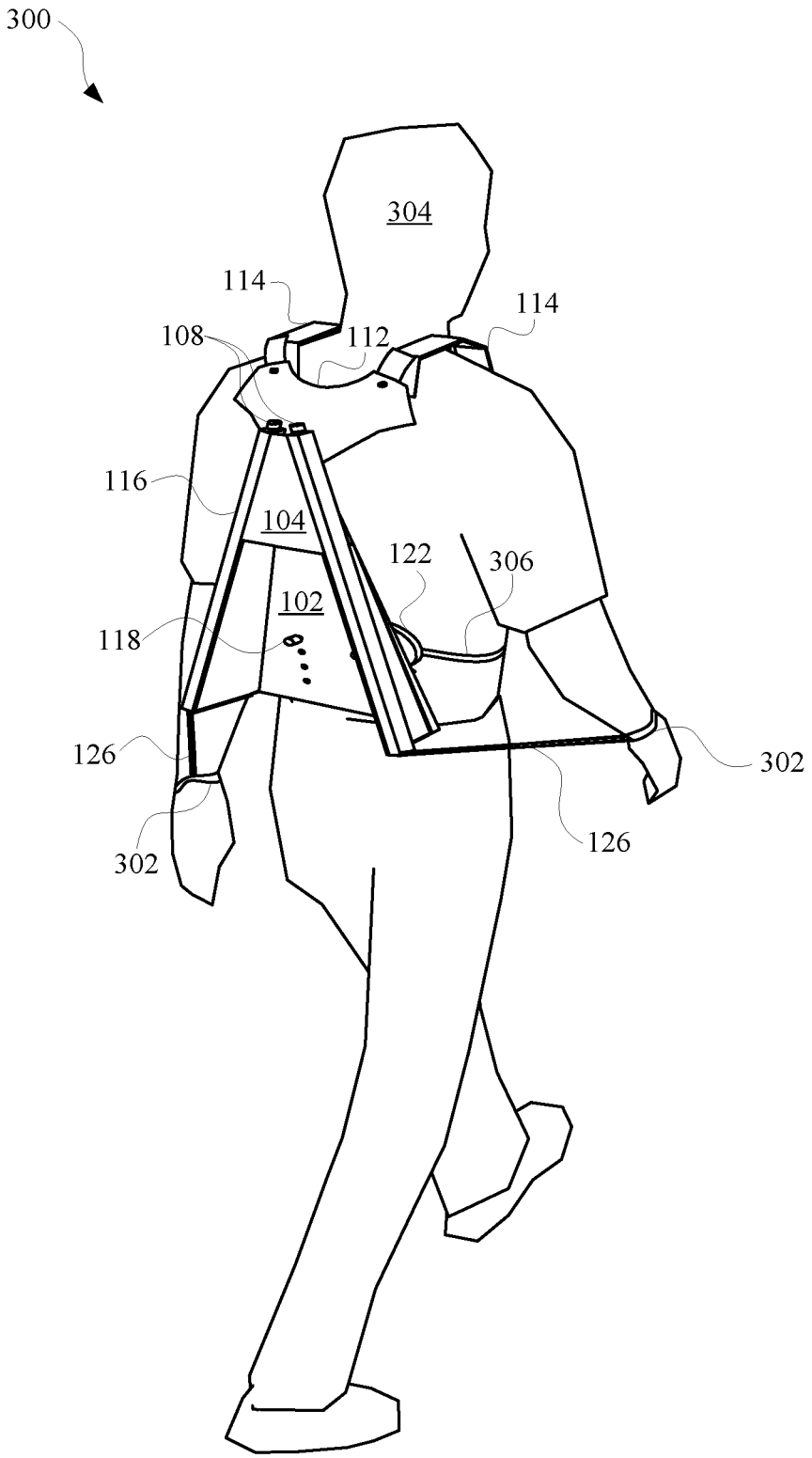
FIG. 3 illustrates a perspective view of a user wearing the body mounted device discussed herein.

FIG. 3 illustrates a perspective view 300 of a user 304 wearing the body mounted device discussed herein. Additionally, FIG. 3 illustrates how a user 304 can secure the body mounted device to their body. In some implementations, the body mounted device can include a strap 306, which can extend from one side of the plate 122, around the torso of the user 304, attach to an opposite end of the plate 122. In other implementations, the body mounted device can include a strap 306 that extends from one side of the plate 122, attach to both straps 114, and attach to the opposite side of the plate 122. The strap 306 can attach to the straps 114 using snap locks, Velcro, hooks, and/or any other apparatus for connecting multiple pieces of material. The body mounted device can further include bands 302. The bands 302 can be attached to appendages of the user 304 in order to allow the appendages to experience some amount of resistance from the cables 126. While wearing the body mounted device, the user 304 can adjust the amount of resistance by reaching other their shoulder and manipulating the adjustable devices 108 located at the ends of the cable guides 116.

Figure 4:
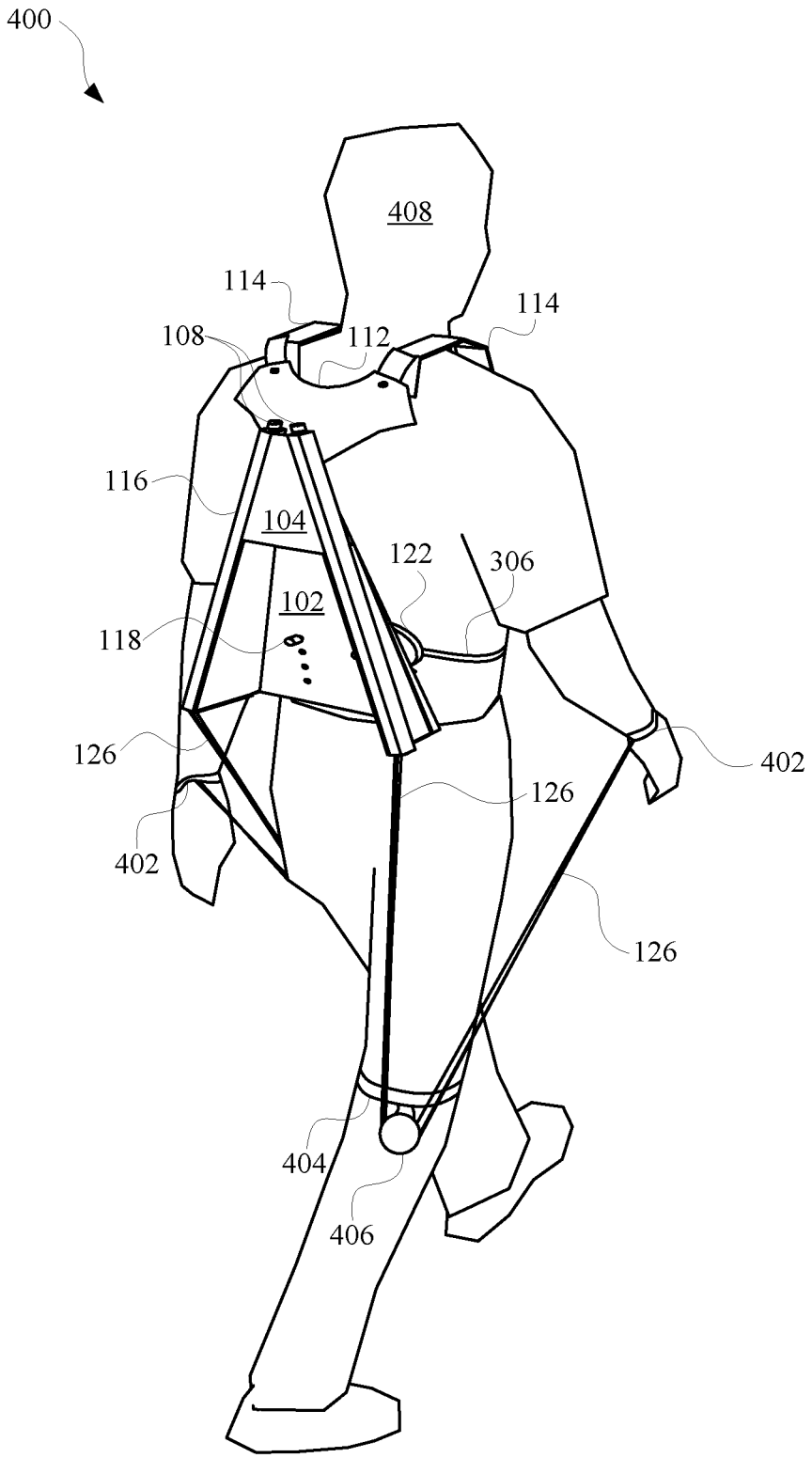
FIG. 4 illustrates a perspective view of a user wearing the body mounted device discussed herein.

FIG. 4 illustrates a perspective view 400 of a user 408 wearing the body mounted device discussed herein. Additionally, FIG. 4 illustrates how a user 408 can secure the body mounted device to their body. In some implementations, the body mounted device can include a band 404 and a band 402, which can distribute an amount of resistance provided by the cables 126 to different portions of the body of the user. For instance, the band 404 can include a pulley 406, which can receive one or more cables 126 from the cable guides 116 and re-direct the one or more cables 126 to a different portion of the body that the band 402 is attached. For instance, as illustrated in FIG. 4, bands 404 can be attached to the legs of the user 408 along with the pulleys 406, and the bands 402 can be attached to the arms of the user 408. In this way, as the user 408 exercises, trains, or performs any other type of suitable motion, the user 408 will experience resistance at their arms and legs.

Figure 5:
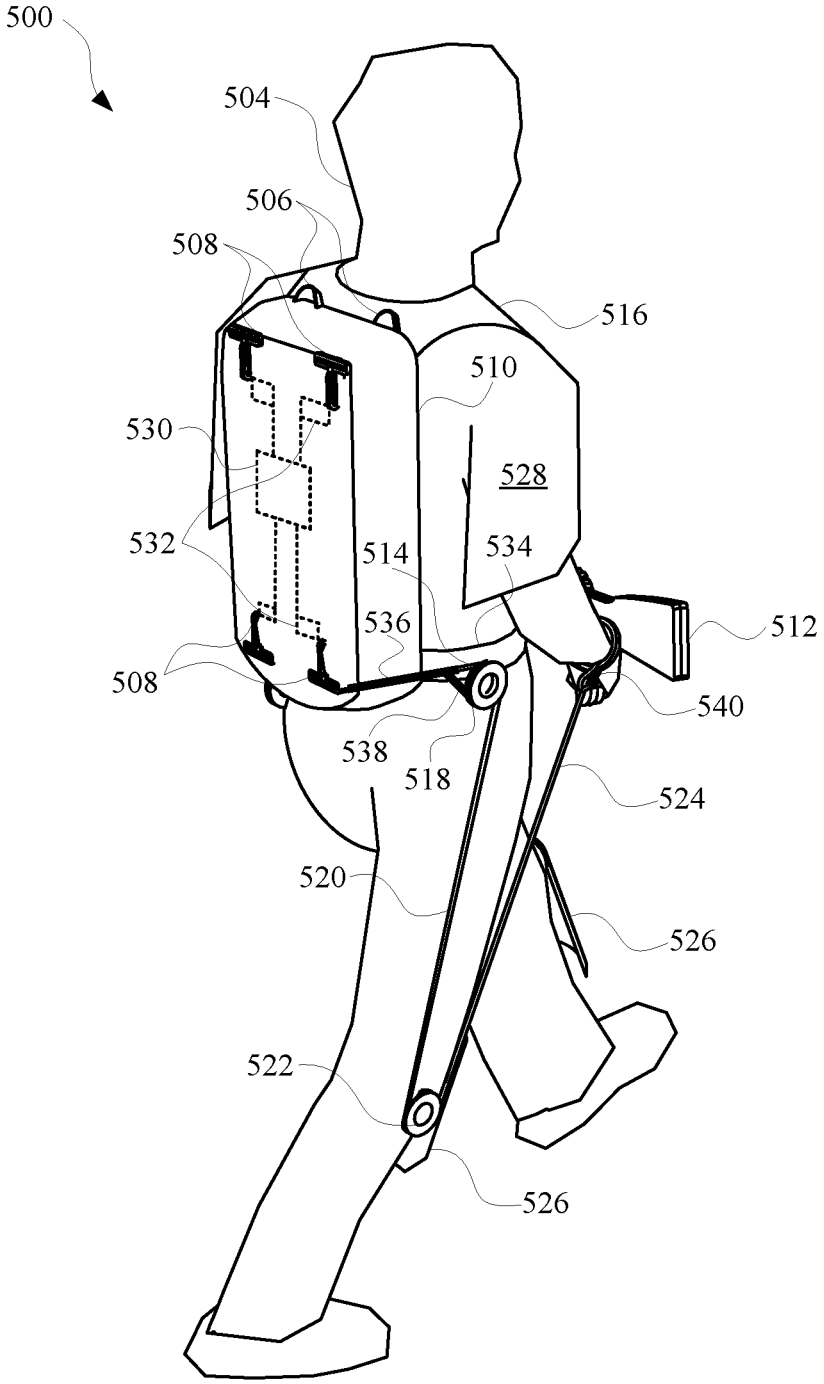
FIG. 5 illustrates a perspective view of a user wearing an implementation of the body mounted device discussed herein.

FIG. 5 illustrates a perspective view 500 of a user 504 wearing an implementation of the body mounted device 510 discussed herein. The body mounted device 510 can include multiple different adjustable cables for providing resistance to various portions of the user 504 during training being undertaken by the user 504. The body mounted device 510 can include straps 508 to which each cable portion (514, 520, and 524) can be attached. Each strap 508 can include one or more snaps or locks for connecting to the body mounted device 510 and/or any other features that are internal to the body mounted device 510. Furthermore, the straps 508 can be adjusted to have different dimensions and/or different tensions. For instance, the straps 508 can be adjusted such that the tension on one side of the body of the user 504 is different than the tension on an opposite side of the body of the user 504. In some implementations, the body mounted device 510 can include hooks 506 and each hook 506 can be used to connect the body mounted device 510 to other apparatuses. For example, each hook 506 can be connected to another resistance training apparatus (e.g., a separate cable or wall) in order to provide another source of resistance during training.

In some implementations, the body mounted device 510 can be attached to a vest 516 that is worn by the user 504 during training. The vest 516 can be a Modular Lightweight Load-Carrying Equipment (MOLLE) vest, worn for tactical training and operations. The body mounted device 510 can be attached to the vest 516 via the hooks 506 and/or any other mechanism for attaching clothing to a mounted device. The vest 516 can include multiple locations in which pulleys (e.g., 518 and 522) can be attached. In this way, the resistance can be applied across the vest 516 using cables and pulleys in order for even and uneven tension to be exerted on the user 504 during training. In some implementations, the body mounted device 510 and/or the vest 516 can be attached to belt 534, and the belt can be attached to a pulley 518. The pulley 518 can be a single pulley or a stack of pulleys capable of guiding one or more cables to various locations at or near portions of the body of the user 504. Furthermore, in some implementations, the pulley 518 can be mountable on location that is separate from the body mounted device 510. For instance, the pulley 518 can be mounted on the belt 534 or pants of the user 504, thereby creating an indirect trajectory for the cable portion 514 and the cable portion 520. The indirect trajectory can provide an intentional off-balance or disproportional resistance over the body of the user 504, improving the plasticity, coordination, and bio-mechanical correction of the user 504.

In some implementations, one or more of the cable portions (514, 520, and 524) can be surrounded by a cable guide 536, which can be a rigid or flexible guide that can protect the cable during training. The cable guide 536 can be positioned at various angles to improve form and positioning of the trainee. The cable guide 536 can be a pipe made from a metal, alloy, plastic, or other rigid material that also allows the cable to move through the cable guide 536 with minimal friction. In some implementations, the body mounted device 510 can include multiple cable guides 536 that can be located between the body mounted device 510 and pulleys. In other implementations, the body mounted device 510 can include a cable guide 536 between two pulleys, such as pulley 518 and pulley 522. In some implementations, the cable guide 536 can be attached to the pulley 518 by a joint 538, which can be a weld, bracket, and/or any other piece of material that can attach a cable guide to a pulley. In this way, the cable guide 536 can be directed to the pulley 518 without slipping during training or other exercises performed by the user 504 while wearing the body mounted device 510.

In some implementations, pulleys can be attached to external pieces of clothing or protective wear, such as kneepads 526. The kneepads 526 can be strapped around the knees of the user 504, and the pulley 522 can be attached to the kneepads 526 at a location that is adjacent to the knees, or otherwise near where the user 504 typically bends their knees. In some implementations, the pulleys 522 can be located above the knees or below the knees, or a pulley 522 can be located above a knee and a different pulley can be located below a different knee. By locating pulleys near the knees, resistance trajectories can be direct toward and/or away from the knees. For instance, a cable portion 524 can extend from the pulley 522 and attach to a wristband 540. The wristband 540 can be an adjustable wristband 540 that can be increased or decreased in diameter in order to secure the wristband 540 to the user 504 during training. In some implementations the wristband 540 can include Velcro portions that allow for adjustment of the wristband 540. In other implementations, the wristband 540 can include buttons, snaps, hooks, or any other mechanical device for securing the wristband 540 in a particular configuration while the wristband 540 is being worn by a user 504.

The wristband 540 can include a cable hook and/or tie ring. In some implementations, the tie ring can be connected between the cable hook and a body of the wristband 540, and the tie ring can be in a static position relative to the body of the wristband 540. Alternatively, the tie ring can surround the wristband 540 and move with the cable portion 524 as the user 504 moves during training. In some implementations, the cable hook can be a carabiner that can be attached to the cable portion 524 and the tie ring. The body mounted device 510 can be attached to at least two wristbands 540, each wristband 540 being located at each wrist of the user 504 in order to create some amount of resistance to a user 504 maneuvering a weapon 512. In some implementations, the body mounted device 510 can be attached to at least four wristbands 540, each wristband 540 being located at both wrists of the user 504 and near both ankles of the user 504.

In some implementations, the body mounted device 510 can include a computing device 530, which can include one or more processors and memory that stores instructions for tracking and analyzing performance of the user 504 during training and exercises. For instance, the computing device 530 can be connected to one or more sensors 532 that can provide signals in response to movements of the user 504 during training and exercises. In some implementations, the sensors 532 can be accelerometers capable of detecting motion in three dimensions. The sensors 532 can be attached directly or indirectly to the cables, the straps 508, and/or any other feature of the body mounted device 510. For instance, the sensors 532 can provide a signal in response to changes in tension of the cables, and the computing device 530 can process the signals to generate data related to the performance of the user 504. Such performance data can include an efficiency metric, an energy metric, a resistance metric, a distance metric, a coordination metric, and/or any other metric that can be used to quantify performance of a person during training or exercise.

Figure 6:
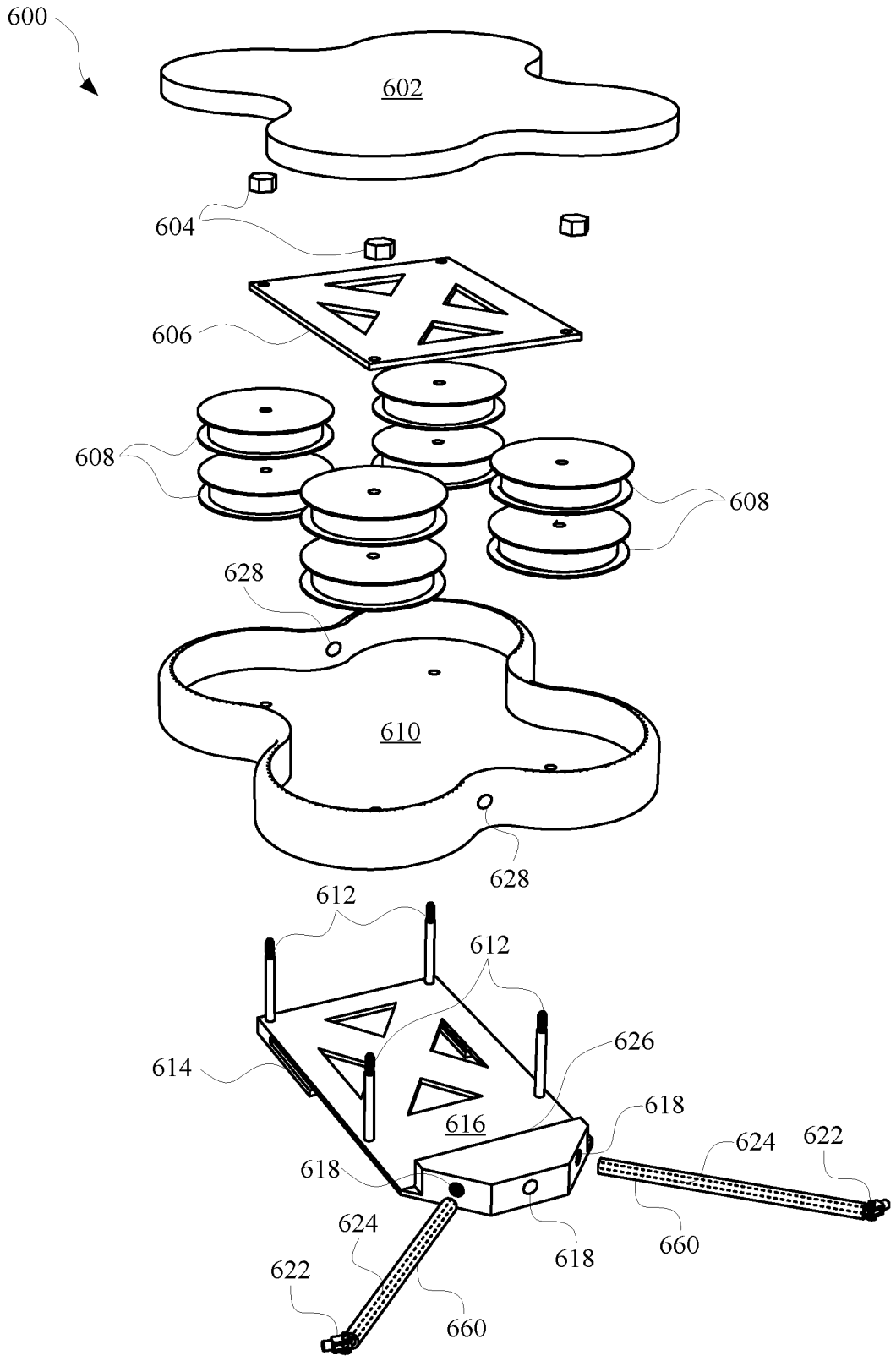
FIG. 6 illustrates an exploded view of a resistance assembly that can be used to provide three dimensions of resistance during exercise or other training.

FIG. 6 illustrates an exploded view of a resistance assembly 600 that can be used to provide three dimensions of resistance during exercise or other training. Specifically, the resistance assembly 600 can be included in a body mounted device for providing a source of cables that have adjustable tensions and can be attached near different portions of a user. The cables can be provided on one or more cable spools 608, which can be contained in a first housing portion 602 and a second housing portion 610. The cable spools 608 can include cable made from metal, non-metal, polymer, and/or any other material that can be formed into a cable. Each cable spool 608 can provide an adjustable amount of tension while a user is wearing the resistance assembly 600. The tensions of the cables can be adjusted at the cable spools 608, a tension devices 604 that secures the cable spools 608 in place, and/or any other feature that can be used to adjust tension of a cable. In some implementations, tension of the cables can be adjusted at a location outside the resistance assembly 600, for example, at a pulley about which a cable is arranged.

In some implementations, the resistance assembly 600 can include four or more cable spools 608, such that each limb of a user (each arm and each leg) can be directly or indirectly attached to a cable for providing some amount of resistance during exercise or other training. One or more cables from each cable spools 608 can be routed through an aperture 628 in the second housing portion 610. For instance, one or more cables can be routed from the cable spools 608 through an aperture 628 located near a clip 614. This cable can routed through the aperture 628, through a pulley near a shoulder or arm of the user, and ultimately attached proximate to the wrist of the user. As the user is maneuvering through their exercises, the cable spools 608 can rotate to release more cable from the cable spools 608 or pull cable back into the cable spools 608. In some implementations, one or more cables can be routed from the cable spools 608, through an aperture 628 located near the pipe mount 626, and through the pipe mount 626. The pipe mount 626 can extend toward a torso or feet of the user when worn by the user, thereby allowing the cable extending through the pipe mount 626 and pipes 620 to be attached to the torso, legs, feet, or other portion of the user. For instance, the user can wear knee braces that have pulleys for directing the movement of the cables. In some implementations, tension provided via the cable spools 608 can be non-uniform in order to improve brain plasticity of a user during an exercise or training. In other words, forcing the user to maintain control of their motion despite having non-uniform forces applied to their body can improve brain plasticity.

In some implementations, the resistance assembly 600 can include multiple at least partially overlapping plates that can be connected by joints 612, which can extend from a second plate 616. The joints 612 can include threaded distal ends and can extend through the second housing portion 610, the cable spools 608, and/or the first plate 606. In this way, the joints 612 can provide rigid support for the cable spools 608. The joints 612 can extend from the second plate 616, through the first plate 606, and the threaded distal ends can receive tension devices 604, such as bolts, or any other apparatus for connecting the first plate 606 to the second plate 616. In some implementations, the tension devices 604 can be arranged to compress or decompress the cable spools 608 in order to increase or decrease an amount of tension applied to the cable spools 608 as a user is exercising. In other implementations, the cable spools 608 can be individually adjusted using a spring or other feature of the cable spools 608.

The first plate 606 and/or the second plate 616 can include cut-out portions that allow air to pass through. In this way, a user wearing the resistance assembly 600 will not accrue condensation on their body as a result of lack of ventilation around their body. Furthermore, because the first plate 606 and the second plate 616 extend over opposing sides of the cable spools 608, each of the first plate 606 and the second plate 616 can protect the cable spools 608 from obstructions. Each clip 614, which can extend from a distal end of the second plate 616, and be arranged to allow the resistance assembly 600 to be attached to the user, such as, for example, at a belt or strap being worn by the user. Alternatively, the resistance assembly 600 can be incorporated into a body mounted device, such as the body mounted device 510 described with respect to FIG. 5. For instance, the resistance assembly 600 can be part of a backpack or vest that is strapped or otherwise worn by a user, and allows the pipes 620 to extend through such that cables can be attached directly or indirectly to the limbs of the user. Moreover, the cable portions described with respect to FIG. 5 can be supplied by the cable spools 608 of the resistance assembly 600 described in FIG. 6. Furthermore, the resistance assembly 600 can be supported by a wearable vest, such as a MOLLE vest.

The resistance assembly 600 can be attached to a computing device that is in communication with one or more sensors for monitoring a performance of a user that is wearing the resistance assembly. For instance, in some implementations, the computing device can measure, monitor, and/or report the performance of the user during exercise, training, and/or rehabilitation. The computing device can use signals from the one or more sensors as feedback, which can provide a basis for modifying the operations of the resistance assembly. For example, the computing device can use motors, solenoids, and/or other devices to modify a resistance or tension of the cables and/or cable spools of the resistance assembly. In this way, the computing device is able to dynamically adjust the resistance assembly in order to improve the performance of the user wearing the resistance assembly.

In some implementations, the sensors in communication with the computing device can include a heart rate monitor, a temperature sensor, a pedometer, a camera, and/or any other sensor capable of monitoring a user. Furthermore, the sensor can measure an interaction with the resistance assembly by, for example, using a position sensor and/or a torque sensor that measure a frequency of movements, torque of certain movements, and/or any other characteristic of movement. The position sensor and/or the torque sensor can be attached to the cable spools, pulleys, cables, and/or any other feature of the resistance assembly 600 that can be responsive to user movements.

The computing device can modify a resistance or a tension of one or more cables of the resistance assembly 600 during an activity being performed by the user. For instance, while a user is running with the resistance assembly 600, a sensor (e.g., a pedometer or torque sensor) can monitor the progress of the user and/or the effort exerted by the user. Such metrics can be based on a frequency of steps of the user and/or a speed at which the user is taking steps. The computing device use the metrics to adjust the resistance or the tension of the cables. For instance, when a metric (e.g., frequency, speed) corresponding to the performance of the user has reached a threshold, the computing device can cause the cables to increase or decrease in tension. The changes in tension can be effectuated by an actuator, solenoid, servo motor, and/or any other device capable of changing a resistance and/or tension of a cable. As a result, the user would have to exert more or less effort while running in order to maintain their speed, or otherwise perform consistently. In this way, the computing device is able to simulate scenarios where the body may be stressed while running.

The computing device can modify resistance and/or tension differently at different portions of the resistance assembly 600. Such modifications can be beneficial during training that involves applying stress to separate areas of the body. For instance, a user may undergo training that involves crawling with a weapon. During the training, one or more sensors can monitor the movements of the user and the computing device can use signals from the sensors to vary the tension on certain cables or pulleys as the user is crawling. For example, a sensor can be used to determine how much force, on average, is being applied by each arm and leg of the user during the training. If the sensor indicates that a difference between forces applied by the right arm and left arm, or right leg and left leg, have reached a difference threshold, the computing device can cause an increase or decrease in tension of cables or pulleys connected to the right side or the left side of the body of the user. In this way, the user will be encouraged to evenly exert force from both sides of the body during training exercises. Alternatively, the computing device can cause an increase or decrease in tension of cables or pulleys connected to the arms or the legs, to ensure that the user is adequately straining their upper body or lower body during training. Such changes in tension at the cables or pulleys can be effectuated by electrical signals transmitted from the computing device to actuators, solenoids, servos, or other devices connected to the cables or pulleys.

In some implementations, the resistance assembly 600 can include a pipe mount 626 arranged to receive one or more pipes 620 through which one or more cables from the cable spools 608 can traverse. For instance, each pipe 620 can be flexible or rigid, and can include a hollow portion 624 that extends through an entire length of the pipes 620. An end of each pipe 620 can optionally include a swivel feature 622 that can allow the cable to be pulled from the cable spools 608 at different directions with minimal changes in friction at the pipe 620. In other words, the swivel feature 622 can act as a ball joint that includes a channel through which the cable can move in and out of. In some implementations, the pipe mount 626 can include at least two cable paths 618 that traverse the pipe mount 626. The cable paths 618 can include threaded portions that that allow the pipes 620 to be screwed into and secured to the pipe mount 626. In some implementations, the pipe mount 626 can be formed to the pipes 620 such that the material of the pipes 620 is shared with the material of the pipe mount 626. In some implementations, the pipe mount 626 can include a cable path 618 that extend perpendicular to the joints 612 and/or parallel to a length of the second plate 616. In this way, a cable from the cable spools 608 can traverse the cable path and extend toward the head or feet of the user (e.g., approximately 90 degrees or 270 degrees relative to the ground on which the user may be exercising).

Figure 7A:
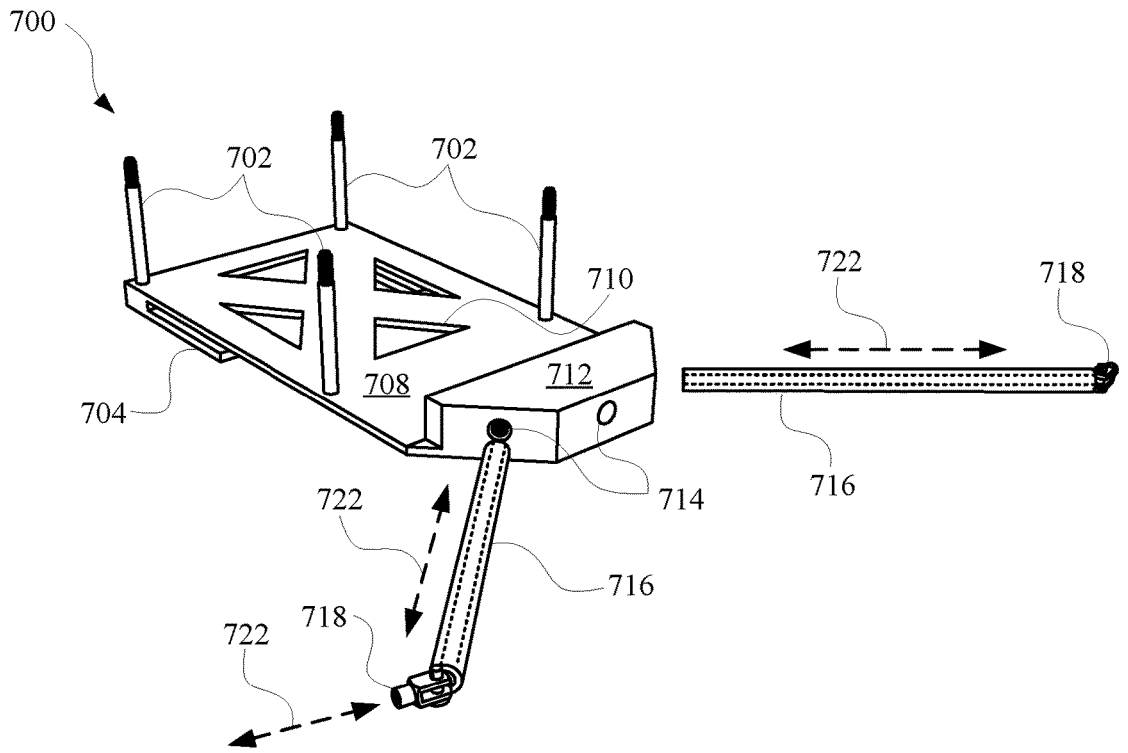
FIGS. 7A and 7B illustrate exploded views of a plate or bracket for a body mounted device that can contain and direct cables for providing resistance when worn during exercises and training.
Figure 7B:
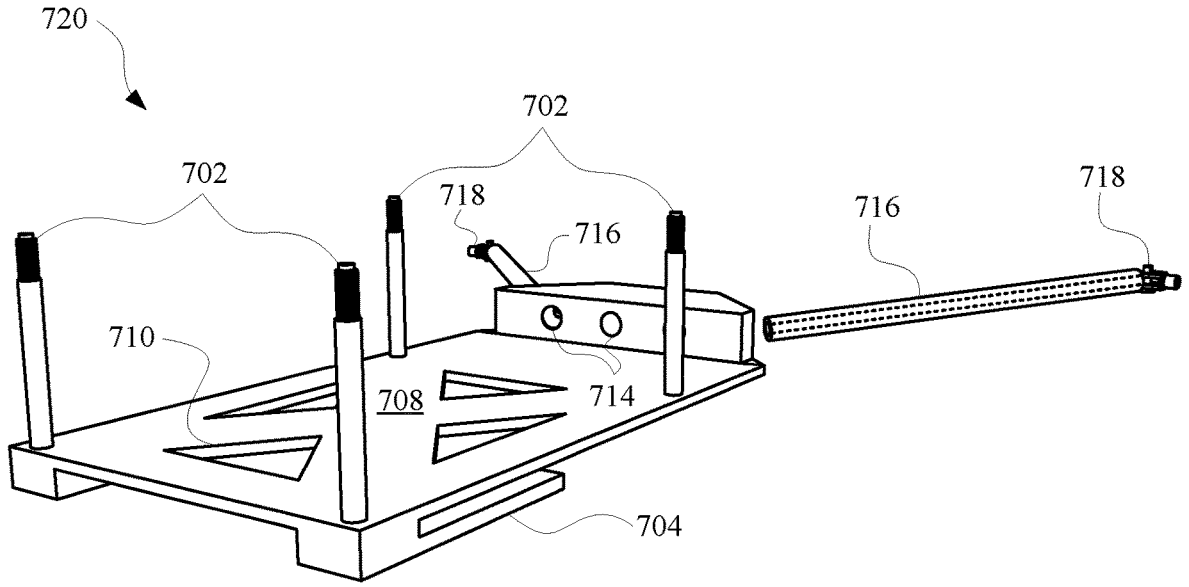

FIG. 7A and FIG. 7B illustrate exploded views 700 and 720 of a plate 708 or bracket for a body mounted device that can contain and direct cables for providing resistance when worn during exercises and training. The plate 708 can be employed as a mount for multiple cable spools and a source through which the cables can be pulled and retracted. In order to mount the multiple cable spools, the plate 708 can include multiple joints 702, which can penetrate apertures of the cable spools and allow each cable spool to rotate about each joint 702. The plate 708 can further include a clip 704 for connecting the plate 708 to a user. For instance, the clip 704 can be connected to a shirt, a belt, a strap, a backpack, or any other clothing item that can be worn by the user. The clip 704 can be located at a distal end of the plate 708 that is opposite a pipe mount 712 of the plate 708.

The pipe mount 712 can include multiple apertures 714 from which pipes 716 can extend to provide pathways for the cables to move. In some implementations, there can be a single aperture 714 at a surface of the pipe mount 712 that is facing the joints 702 and multiple apertures that extend from the single aperture 714 in an opposite direction. In this way, there can be a single opening in which the cables from the cable spools can enter. The apertures 714 at the end of the pipe mount 712 facing away from the joints 702 can include threads for connecting the pipes 716 to the pipe mount 712. Each pipe 716 can include a hollow channel through which the cables can move in and out of, according to direction 722. In some implementations, the pipes 716 can include an open end, while in other implementations the pipes 716 can include pivoting ends 718 that can change a direction of an opening of the pipes 716. For instance, the pivoting ends 718 can simultaneously face away from the plate 708 or towards the plate 708. In other implementations, the pipes 716 can be flexible in order to provide additional tension when the user is wearing the plate 708 and pulling on the cables.

In some implementations, the plate 708 can include apertures 710 for providing flexibility and breathability to the plate 708. Furthermore, the apertures 710 can allow a user to see the cables provided from the cable spools, thereby allowing the user diagnose any issues that may occur with the cables. The apertures 710 also reduce the weight of the plate 708, making it easier to carry during exercises and training.

Figure 8:
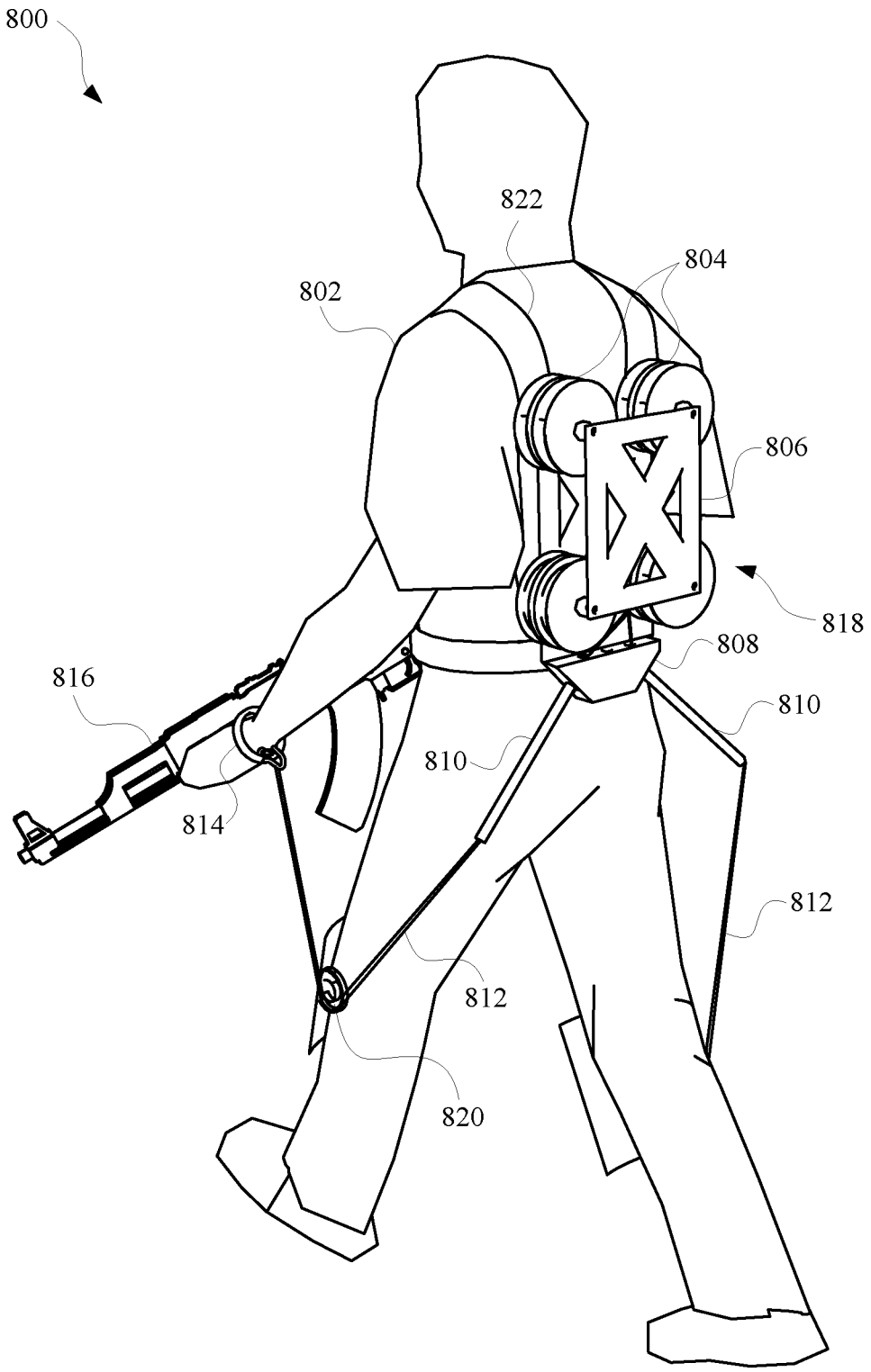
FIG. 8 illustrates a perspective view of a user wearing a resistance assembly as discussed herein.

FIG. 8 illustrates a perspective view 800 of a user 802 wearing a resistance assembly 818 as discussed herein. The resistance assembly 818 can supply cables 812 to different appendages (e.g., arms, legs, etc.) of the user 802 in order to provide tension to those appendages during exercises and training. The resistance assembly 818 can supply the cables 812 from cable spools 804 attached to the resistance assembly 818. The cables 812 can extend under a plate 806 of the resistance assembly 818 and through a pipe mount 808 of the resistance assembly 818. Thereafter, the cables 812 can extend through pipes 810, which can be attached to the pipe mount 808 and direct the cables 812 in different directions. For instance, when the resistance assembly 818 is being worn by the user 802, each pipe 810 can extend toward a foot, a knee, and/or a thigh of the user 802. In this way, the cables 812 moving through the pipes 810 will not interfere with any other areas of the user 802 beyond where the cables 812 are connected.

In some implementations, the cables 812 can be routed around pulleys 820, which can be attached at different locations of the user 802. For instance, a pulley 820 can be attached to a knee strap such that that a cable 812 can extend toward the knee and up to the wrist of the user 802, thereby applying tension at both the knee and wrist of the user 802. Applying tension at multiple locations of the user 802 can improve exercise and training of, for example, a soldier that typically must deal with various terrains and obstacles. If a soldier needs to train with a weapon 816, a cable 812 from the resistance assembly 818 can be routed through a pipe 810, around a pulley 820, and attached to a wristband 814. In this way, as the user 802 is moving with their weapon 816, the wrist and knee of the user 802 will experience some amount of tension. In some implementations, the amount of tension of cables 812 moving through each pipe 810 can be adjusted. For instance, a cable 812 moving through a pipe 810 at the left side of the user 802 can have a different amount of tension than a cable 812 moving through a pipe 810 at the right side of the user 802.

The user 802 can wear the resistance assembly 818 by attaching the resistance assembly 818 to a backpack 822 using clips that extend from a plate of the resistance assembly 818. In this way, the resistance assembly 818 acts as a portable wearable apparatus that can provide tension in three dimensions. For instance, when the user 802 is climbing stairs while wearing the resistance assembly 818 and holding the weapon 816, tension will be applied to each knee as the user 802 lifts each leg to go up the stairs. Additionally, as the user 802 lifts the weapon 816 up each stair, the wrist of the user 802 will receive consistent tension from the cable 812 that is wrapped around the pulley 820.

Although the resistance assembly 818 is illustrated as guiding the cables 812 below the torso of the user 802, in some implementations the cables can also be directed above the torso of the user 802. For instance, the resistance assembly 818 can include a hooks on the backpack 822 that direct the cables 812 over the shoulders of the user 802 and connect to the chest and/or wrists of the user 802 in order to apply tension to the chest and/or wrists during exercises. In other implementations, the resistance assembly 818 can include a pipe mount 808 that extends toward the feet of the user 802 and a separate pipe mount that faces toward the head of the user 802. In this way, cables can be directed via pipes over the shoulders of the user 802 simultaneous to cables 812 being directed toward the legs of the user 802. Each cable can be provided by a separate spool 804 thereby allowing each appendage of the user 802 to be assigned a separate amount of tension.

In some implementations, the resistance assembly 818 can include a computing device that is connected behind the plate 806 for tracking the performance of the user 802 while the user 802 is wearing the resistance assembly 818. For instance, the computing device can be connected to sensors that can measure an amount of pulling force being applied by each cable 812. The data from the sensors can be processed and recorded in order to compare past performances of the user 802, and/or compare performances of different users. In some implementations, the computing device can control the amount of tension applied to the cables. For instance, during an exercise, the computing device can cause the cable spools 804 to increase or decrease tension in order to provide variability during the exercise.

Figure 9:
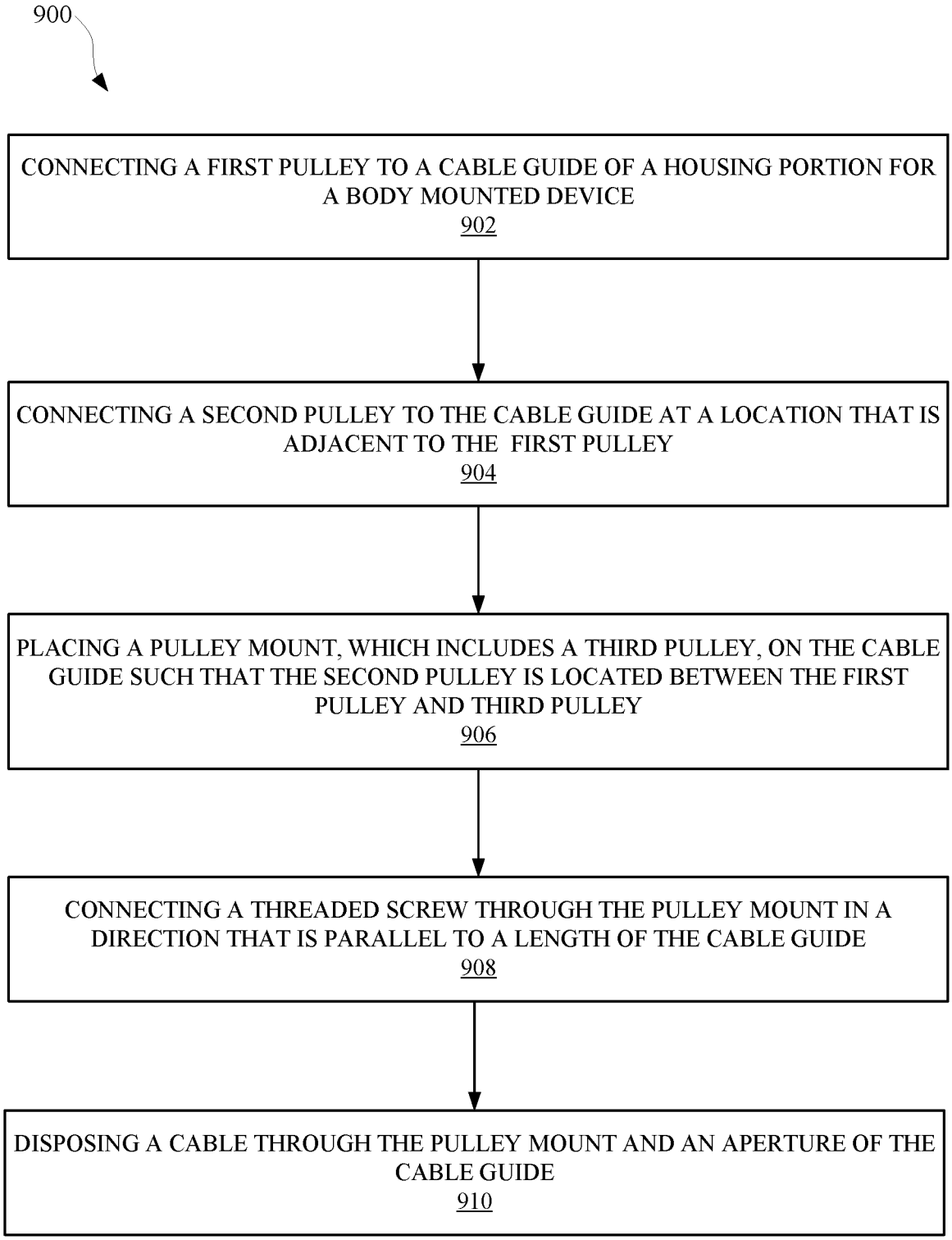
FIG. 9 illustrates a method for assembling a cable assembly for a body mounted device.

FIG. 9 illustrates a method 900 for assembling a cable assembly for a body mounted device. The method 900 can be performed by one or more computers, applications, and/or any other apparatus or module capable of assembly a wearable device. The method 900 can include an operation 902 of connecting a first pulley to a cable guide of a housing portion for a body mounted device. The first pulley can be connected to the cable guide by a pin or nut that extends through the first pulley and a surface of the cable guide. The method 900 can further include an operation 904 of connecting a second pulley to the cable guide at a location that is adjacent to the first pulley. The second pulley can also be connected to the cable guide by a pin or nut that extends through the second pulley and another surface of the cable guide. The method 900 can additionally include an operation 906 of placing a pulley mount, which includes a third pulley, on the cable guide such that the second pulley is located between the first pulley and the second pulley.

The method 900 can further include an operation 908 of connecting a threaded screw through the pulley mount in a direction that is parallel to a length of the cable guide. The pulley mount can be adjustable by way of an adjustable device that is connected to the threaded screw, which can extend through a threaded aperture of the pulley mount. The method 900 can optionally include an operation 910 of disposing a cable through the pulley mount and an aperture of the cable guide. A tension of the cable can be adjusted based on location of the pulley mount relative to the first pulley and/or the second pulley. The location of the pulley mount is adjusted according to the rotation of the threaded screw, which can be rotated by a user that wears the body mounted device.

Figure 10:
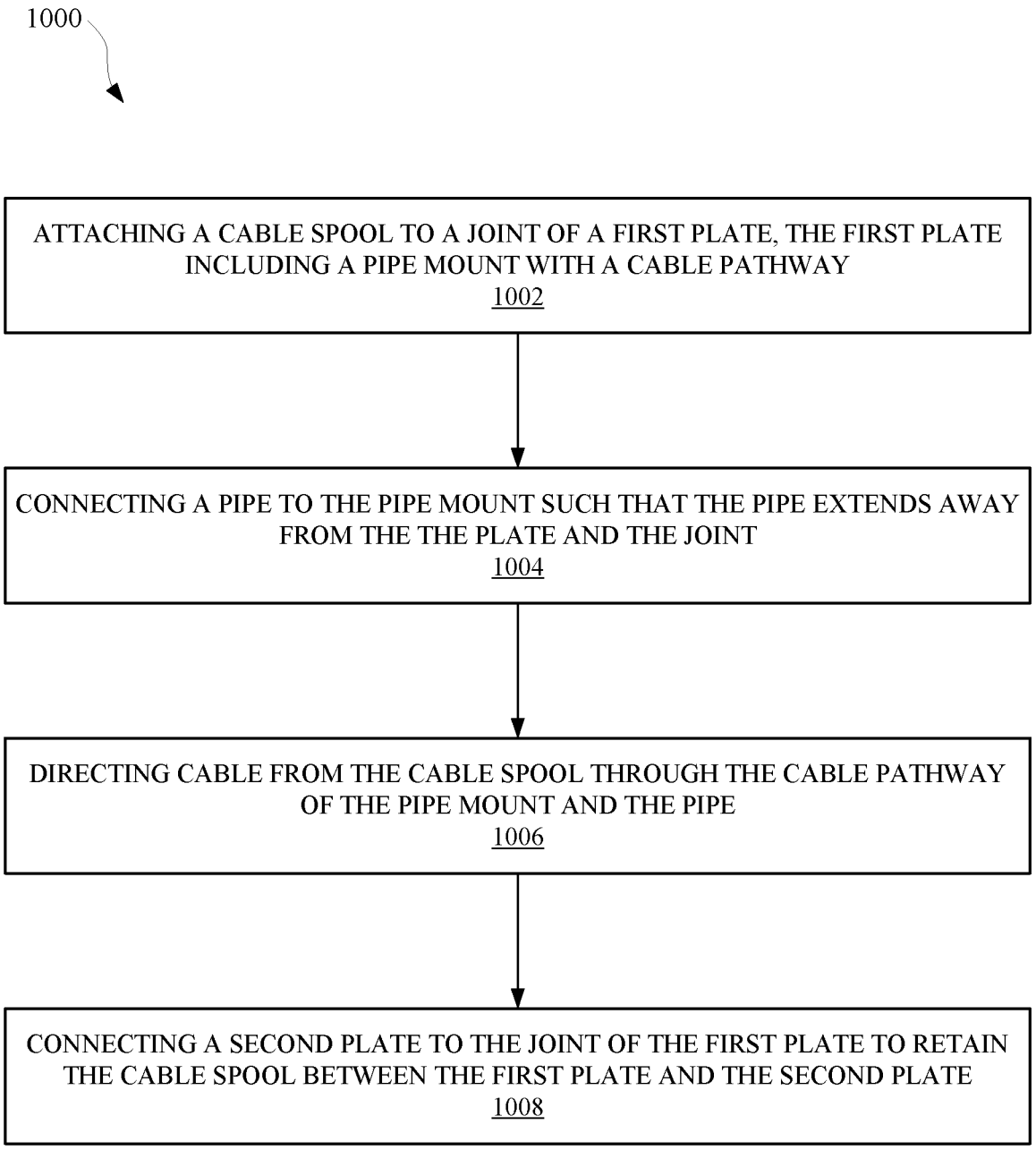
FIG. 10 illustrates a method for manufacturing a resistance assembly according to some embodiments discussed herein.

FIG. 10 illustrates a method 1000 for manufacturing a resistance assembly according to some embodiments discussed herein. The method 1000 can be performed by one or more computing devices, or any other apparatuses capable of manufacturing an exercise device. The method 1000 can include an operation 1002 of attaching a cable spool to a joint of a first plate, the first plate including a pipe mount with a cable pathway. The cable spool can be a circular spool of cable with an aperture through which the joint of the first plate can extend through. The first plate can be made from a light, rigid material such as aluminum, plastic, and/or any other material that can be formed into a wearable product. The pipe mount can also be made from a rigid material that is capable of being formed with cable pathways. The cable pathways can be formed into the pipe mount in multiple directions, through opposing surfaces of the pipe mount. For instance, multiple cable pathways can be connected to openings in a common surface of the pipe mount and terminate at different surfaces of the pipe mount.

The method 1000 can further include an operation 1004 of connecting a pipe to the pipe mount such that the pipe extends away from the plate and the joint. The pipe can be a flexible or rigid, hollow tube that can extend from the pipe mount and away from the first plate. The pipe can be screwed into the pipe mount, formed to the pipe mount, welded to the pipe mount, or otherwise attached to the pipe mount so that a uniform cavity can extend through the pipe and the cable pathway. In some implementations, multiple pipes can be attached to the pipe mount such that each pipe extends from the pipe mount in different directions. This configuration allows for cables to be extended from the cable spools in different directions, thereby allowing tension vectors created by the cables to affect a user while wearing the first plate during an exercise.

The method 1000 can further include an operation 1006 of directing cable from the cable spool through the cable pathway of the pipe mount and the pipe. Directing cable from the cable spools through the cable pathway can include unwinding the cable from a cable spool, pushing the cable through an opening in the pipe mount, and pulling the cable out of the pipe connected to the pipe mount. In some implementations, multiple cables are pulled from the cable spools, through the pipe mount, and through the pipes that are connected to the pipe mount.

The method 1000 can further include an operation 1008 of connecting a second plate of the joint of the first plate to retain the cable spool between the first plate and the second plate. The second plate can extend parallel over the first plate and can optionally abut the pipe mount. In some implementations, each of the first plate and the second plate can include openings that reduce the weight of the plates and/or allow air to move through the plates. The cable from the spools can move between the plates during exercises performed by the user thereby protecting the cables and reducing the amount of interference between the environment and the cables. The cables can be extended around pulleys that can be attached at different locations on the appendages of the user. For instance, the cables can be attached to the wrists of the user while also being directed around pulleys that are attached to the knees of the user. The cable spools can provide an amount of tension that requires the user to exert effort when moving their wrists away from their knees. In some implementations, the cable spools can be adjusted to so that different amounts of tension are applied to the wrists of the user.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope.

We claim:

1. A wearable apparatus, comprising:

a housing portion comprising one or more cable guides configured to direct cables from the housing portion in different directions; and a pulley assembly that includes a plurality of pulleys and a pulley mount, wherein the pulley assembly is configured to modify an amount of tension exhibited by the cables, and wherein the pulley assembly includes:

a first pulley that is proximate to an aperture of a cable guide of the one or cable guides, a second pulley connected between the first pulley and the pulley mount, a third pulley connected to the pulley mount, and a threaded portion that extends through the pulley mount, wherein the pulley mount is configured to move along a length of the cable guide when the threaded portion receives a rotational force.

2. The wearable apparatus of claim 1, further comprising:

a mounting plate that extends from a first portion of the housing portion; and a back plate that extends from a second portion of the housing portion.

3. The wearable apparatus of claim 2, wherein the second portion of the housing portion includes apertures through which pins connect the back plate to the second portion of the housing portion.

4. The wearable apparatus of claim 3, wherein the pins are compressible and displace the back plate a distance from the second portion of the housing portion.

5. The wearable apparatus of claim 1, wherein the housing portion includes non-parallel interior walls, and each cable guide of the one or more cable guides extend along a respective interior wall of the non-parallel interior walls.

6. The wearable apparatus of claim 1, wherein the pulley assembly is at least partially disposed within a cable guide of the one or more cable guides.

7. The wearable apparatus of claim 1, wherein at least one cable of the cables extends into a cable guide of the one or more cable guides, curves around at least three pulleys of the plurality of pulleys, and extends out of the cable guide of the one or more cable guides.

8. A wearable apparatus, comprising:

a housing portion that includes a first cable guide and a second cable guide configured to direct cables in different directions from the housing portion; and a first pulley assembly connected to the first cable guide and a second pulley assembly connected to the second cable guide, wherein each of the first pulley assembly and the second pulley assembly include a plurality of pulleys, a pulley mount, and a threaded portion that extends through the pulley mount; and a control system that includes a sensor and an actuator that is configured to modify an arrangement of the first pulley assembly or the second pulley assembly according to an output from the sensor.

9. The wearable apparatus of claim 8, wherein the first cable guide and the second cable guide are non-parallel and at least partially envelop the first pulley assembly and the second pulley assembly, respectively.

10. The wearable apparatus of claim 8, further comprising a curved mounting plate and pivotable straps extending from the curved mounting plate.

11. The wearable apparatus of claim 10, further comprising a chest strap that is connected to each of the pivotable straps and extends between the pivotable straps.

12. The wearable apparatus of claim 8, wherein the threaded portion extends between two pulleys of the plurality of pulleys, and wherein the two pulleys are attached to the pulley mount.

13. A method for operating a body mountable device, the method comprising:

receiving an amount of force at a pulley assembly that is connected to the body mountable device, wherein the pulley assembly is configured to adjust an amount of tension exhibited by a cable that extends from the body mountable device;

modifying an arrangement of the pulley assembly in response to receiving the amount of force, wherein modifying the arrangement includes displacing a location of a pulley mount of the pulley assembly, wherein the pulley assembly is controlled by a control system that includes a motor and a sensor, and the amount of force received at the pulley assembly is provided by the motor; and causing the amount of tension exhibited by the cable to be adjusted in response to modifying the arrangement of the pulley assembly, wherein the amount of tension is at least partially dependent on the location of the pulley mount relative to a pulley that is disposed within a cable guide of the body mountable device.

14. The method of claim 13, wherein the cable is disposed about the pulley and a separate pulley, and the separate pulley is attached to the pulley mount.

15. The method of claim 13, wherein the sensor is responsive to an environmental condition of the body mountable device or a separate device, and the amount of tension exhibited by the cable is at least partially based on an output of the sensor.

16. The method of claim 13, wherein the pulley mount includes cable apertures through which the cable extends.

17. A wearable apparatus, comprising:

a housing portion that includes a first cable guide and a second cable guide configured to direct cables in different directions from the housing portion; and a first pulley assembly connected to the first cable guide and a second pulley assembly connected to the second cable guide, wherein each of the first pulley assembly and the second pulley assembly include a plurality of pulleys, a pulley mount, and a threaded portion that extends through the pulley mount, wherein the threaded portion extends between two pulleys of the plurality of pulleys, and wherein the two pulleys are attached to the pulley mount.

* * * * *